US011607595B2

(12) United States Patent
Corniel

(10) Patent No.: US 11,607,595 B2
(45) **Date of Patent: *Mar. 21, 2023**

(54) BASEBALL/SOFTBALL HITTING TRAINING DEVICE

(71) Applicant: Sheree D. Corniel, Las Vegas, NV (US)

(72) Inventor: Sheree D. Corniel, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/099,660

(22) Filed: Nov. 16, 2020

(65) Prior Publication Data

US 2021/0069565 A1 Mar. 11, 2021

Related U.S. Application Data

(63) Continuation-in-part of application No. 16/726,705, filed on Dec. 24, 2019, now Pat. No. 10,835,798, which is a continuation-in-part of application No. 15/970,806, filed on May 3, 2018, now abandoned.

(60) Provisional application No. 62/500,926, filed on May 3, 2017.

(51) Int. Cl.

| | |
|---|---|
| ***A63B 71/00*** | (2006.01) |
| ***A63B 69/00*** | (2006.01) |
| ***A63B 71/02*** | (2006.01) |
| *A63B 102/18* | (2015.01) |

(52) U.S. Cl.

CPC ..... *A63B 69/0084* (2013.01); *A63B 69/0002* (2013.01); *A63B 69/0075* (2013.01); *A63B 71/023* (2013.01); *A63B 2069/0008* (2013.01); *A63B 2071/025* (2013.01); *A63B 2071/026* (2013.01); *A63B 2102/182* (2015.10); *A63B 2210/50* (2013.01); *A63B 2225/093* (2013.01)

(58) Field of Classification Search

CPC ..... A63B 69/00984; A63B 69/0002; A63B 69/0075; A63B 2069/0008; A63B 2102/182; A63B 2071/026; A63B 2071/025; A63B 2210/50; A63B 2225/093; A62B 71/023

USPC ..... 473/417, 451, 422–430, 453, 454, 419

See application file for complete search history.

(56) References Cited

U.S. PATENT DOCUMENTS

| | | | | |
|---|---|---|---|---|
| 708,573 | A * | 9/1902 | Miles | A63B 69/0079 473/426 |
| 1,554,409 | A | 9/1925 | Coffee | |
| 2,247,072 | A | 6/1941 | Stow | |

(Continued)

*Primary Examiner* — Mitra Aryanpour

(74) *Attorney, Agent, or Firm* — Connie R. Masters

(57) ABSTRACT

The baseball/softball hitting training device includes a base, a frame body, and a ball suspension system. The ball suspension system is supported by the frame body. The frame body includes a vertical stem portion and an offset portion. An upwardly-projecting arm of the vertical stem and a downwardly-projecting arm of the offset portion define a vertical axis between them. The ball suspension system is supported between the upwardly-projecting arm and downwardly-projecting arm, with the ball held vertically intermedially via a tether in alignment with the vertical axis and positioned to allow the player to practice hitting. In some aspects, a height-adjustment mechanism and/or additional coupling assemblies are also disclosed. The tethered-ball training device can optionally be converted to a tee-ball training device.

17 Claims, 18 Drawing Sheets

(56) References Cited

U.S. PATENT DOCUMENTS 2,249,309 A * 7/1941 Benko ..... A63B 69/203 482/84
3,475,026 A * 10/1969 Cooper ..... A63B 69/0002 473/430
3,630,521 A 12/1971 Lingbeek et al.
3,716,235 A 2/1973 Yerkie
3,729,194 A * 4/1973 Barnett ..... A63B 43/007 473/426
3,908,992 A * 9/1975 Cunningham ..... A63B 63/008 473/477
3,948,517 A * 4/1976 Feiler ..... A63B 69/0079 473/429
4,088,316 A * 5/1978 Szafianski ..... A63B 69/0084 473/426
4,372,561 A 2/1983 Morgan et al.
4,664,375 A * 5/1987 Tetreault ..... A63B 69/0079 473/429
4,735,413 A * 4/1988 Yamanouchi ..... A63B 69/0084 473/426
4,867,448 A * 9/1989 Judd ..... A63B 69/0084 473/426
4,881,742 A 11/1989 Hargreave
4,886,267 A * 12/1989 Licciardi ..... A63B 69/0075 473/417
4,966,367 A * 10/1990 Oyarzabal ..... A63B 69/0084 473/426
4,991,840 A 2/1991 Patton
5,029,852 A * 7/1991 Gilfillan ..... A63B 69/0002 473/417
5,040,791 A 8/1991 Ratajac et al.
5,056,784 A * 10/1991 Craig ..... A63B 69/0084 473/426
5,060,946 A 10/1991 Taylor
5,072,937 A * 12/1991 Zarate ..... A63B 69/0084 473/426
5,087,039 A * 2/1992 Laseke ..... A63B 69/0002 473/417
5,340,101 A 8/1994 Lawson et al.
5,419,550 A 5/1995 Blom
5,478,070 A * 12/1995 Morrison ..... A63B 69/0075 473/419
5,554,088 A * 9/1996 Zlojutro ..... A63B 69/004 482/83
5,588,646 A 12/1996 Dickson
5,662,537 A 9/1997 Zuber
5,685,542 A 11/1997 Weis
5,713,805 A 2/1998 Scher et al.
5,776,017 A 7/1998 Brawn
5,795,250 A 8/1998 Cripe
5,873,798 A * 2/1999 Bostick ..... A63B 69/0084 473/426
5,957,781 A * 9/1999 Kelly ..... A63B 69/0084 473/140
6,168,540 B1 1/2001 McKenna
6,306,050 B1 10/2001 Holder
6,511,390 B2 * 1/2003 Kim ..... A63B 63/00 473/439
6,514,161 B1 * 2/2003 Minniear ..... A63B 69/0002 473/423
6,666,781 B1 * 12/2003 Illis ..... A63B 69/0002 473/417
6,790,150 B1 9/2004 Moss et al.
7,041,016 B1 5/2006 Omtvedt
7,214,147 B2 * 5/2007 Gutierrez ..... A63B 69/0002 473/417
7,252,603 B2 8/2007 Bove et al.
7,300,388 B2 11/2007 Sams, III
7,494,432 B2 2/2009 Flanigan
7,662,052 B1 * 2/2010 Vidrine ..... A63B 69/0002 473/417
7,704,169 B1 4/2010 Bove et al.
7,914,400 B2 3/2011 Flading et al.
8,784,240 B1 7/2014 Buono et al.
8,932,155 B2 1/2015 Moore
9,011,277 B2 * 4/2015 Schell ..... A63B 69/0002 473/422
9,039,548 B2 5/2015 Sams, III
9,061,190 B2 * 6/2015 Willardson ..... A63B 69/0002 473/429
9,687,711 B2 * 6/2017 Brian ..... A63B 69/0002 473/426
10,245,493 B2 4/2019 Beedle et al.
10,835,798 B2 * 11/2020 Corniel ..... A63B 71/023 473/417
2009/0291780 A1 11/2009 Gutierrez
2010/0298074 A1 * 11/2010 Esposito ..... A63B 69/00 473/438

* cited by examiner

BASEBALL/SOFTBALL HITTING TRAINING DEVICE

CROSS-REFERENCE TO RELATED APPLICATIONS

This nonprovisional application is a continuation-in-part of co-pending U.S. patent application Ser. No. 16/726,705 filed on Dec. 24, 2019 (U.S. patent Ser. No. 10,835,798 issued Nov. 16, 2020), which was a continuation-in-part application of U.S. patent application Ser. No. 15/970,806 filed on May 3, 2018, which claimed the benefit of U.S. Provisional Patent Application Ser. No. 62/500,926, filed on May 3, 2017, which are incorporated herein in their entirety.

FIELD OF INVENTION

This invention relates generally to athletic training equipment and, more particularly, to a baseball and/or softball batting or hitting swing training apparatus which has a ball suspended on a tether line between two arms and which is convertible to a batting tee.

BACKGROUND

The skills of a good batter are highly valued on a baseball or softball team, but hitting a small spherical ball, such as a baseball or softball, with a long, tapered bat is a skill that takes time to master. Though having a pitcher pitch the ball to the batter is an excellent means of practicing hitting, it is not efficient or convenient. Therefore, numerous prior art hitting/batting training devices have been developed to allow a batter to improve baseball/softball batting swing skills without the need for other players to pitch or to retrieve the ball.

Many of these hitting/batting practice devices are designed for permanent installation at a practice field, so are not movable to, or usable at, a batter's home where the player would have more practice time to perfect his/her skills. These include U.S. Pat. Nos. 4,322,075, 4,898,385, and 5,766,102. Other devices are potentially movable, but they are bulky and difficult to set up and to transport and not suitable for indoor use, such as the devices disclosed in U.S. Pat. Nos. 5,040,791, 5,072,937, 5,340,101, 5,588,646, 5,795,250, 6,168,540, 6,306,050, 7,252,603, 7,494,432, 7,914,400, and 9,039,548.

Only a small subset of prior art devices seeks to allow a player to practice in a small space, and the disclosures of this subset provide a training device with a central axis, but with the ball mounted in a position offset from the central axis. The repetitive impacts to the device from the strikes on the offset ball cause substantial repetitive torsional forces on the training device, which causes instability and structural damage.

Additionally, the cost of providing adequate training equipment is not insignificant. Therefore, it would be advantageous to parents and coaches to have two separate hitting training devices incorporated into a single piece of training equipment. This would increase the types of training available, increase the versatility of the hitting training device, reduce the cost compared to two separate devices, and reduce the space needed for storage compared to storing two devices.

Accordingly, there is a need for baseball/softball hitting training device that is small and stable enough to use indoors or outdoors, that tethers the ball to remove the need for ball retrieval, that positions the ball to simulate the actual location of a pitched ball, that is easily adjusted for differing player heights and types of ball drills, that deals advantageously with the force imparted to the device when the ball is hit compared to prior art devices, and that can be reconfigured to form a separate training device, a batting tee.

BRIEF SUMMARY OF THE INVENTION

The present invention is directed to a baseball and/or softball hitting training device that includes a base, a frame body, and a ball suspension system. The frame body is supported by the base, which rests on the ground. The ball suspension system is supported by the frame body.

The base includes a horizontal bracing portion (legs or a fillable container) and an upright and upwardly-extending base upright casing that accommodates (fits into or fits over) the bottom of the frame body.

The frame body includes a vertical stem portion and an offset portion. An upwardly-projecting arm of the vertical stem and a downwardly-projecting arm of the offset portion define a vertical axis between them with the ball held vertically by a tether in alignment with this vertical axis. Through available adjustments the baseball and/or softball hitting training device allows vertical height adjustment to accommodate the height of the player and preferably allows adjustment to the vertical swing distance to enable both advanced and beginning players to efficiently practice swinging.

The vertical stem portion includes at least two sections that are vertically aligned, a vertical stem support section and an upwardly-projecting arm. The offset portion of the device is attached to the top of the stem support section. The upwardly-projecting arm extends above the intersection where the offset portion attaches to the stem support section to secure the bottom end of the suspension system. The stem upwardly-projecting arm and the stem support section may be formed integrally as in FIG. 1 or may comprise two separate pieces as in FIG. 14. The embodiment of FIG. 14 includes an upwardly-projecting arm height-adjustment system disposed at the juncture of the stem support and the upwardly-projecting arm. This arm height-adjustment system allows the upwardly-projecting arm to be raised, thus decreasing the swing opening (the vertical distance between the upwardly-projecting arm and the downwardly-projecting arm of the offset portion) to provide a challenge for highly skilled players. The arm height-adjustment system also allows the upwardly-projecting arm to be lowered to increase the swing opening, such as may be needed for training less advanced players.

The offset portion is supported by the vertical stem support section of the frame body. A part of the offset portion extends away from, and is not in line with, the centerline of the vertical stem support section, but the distal part of the offset portion (the downwardly-projecting arm of the offset portion) is in line with the centerline of the vertical stem to hold the ball suspension system in line with the centerline (vertical axis) of the vertical stem.

Therefore, in contrast to the hitting training devices of the prior art that disclose a ball mounted in the offset position, the ball of the current invention is mounted in line with the centerline of the vertical stem. It is believed that with the ball in line with the vertical stem centerline, the impacts experienced will cause bending or displacement forces to the structure and will cause less torsional force than prior art devices. The prior art devices, due to these torsional forces, inherently require a more robust structure to resist distortion and/or movement than the present invention. Therefore, the present invention is believed to provide greater stability with less weight and a smaller base and, thus, has advantages in indoor use and in storage and transportation.

In one aspect of the invention, a separate insertable training tee is included. In this aspect, the vertical stem and the offset portion are removed, and the training tee is inserted into the top portion of the base upright portion of the base.

In a further aspect of the invention, the training device is converted to a training tee by using one leg of the base. In this aspect the batting tee is created by the insertion of a leg of the base into the top of the base upright portion (after the removal of the vertical stem along with the offset portion).

In another aspect of the invention, the offset portion is C-shaped with a substantially horizontal lower offset portion, a substantially vertical offset midportion, a substantially horizontal upper offset portion, and a substantially vertical downwardly-projecting arm.

In an additional aspect of the invention, the offset portion is C-shaped.

In a further aspect of the invention, the offset portion is attached within the top thirty percent of the vertical stem, but not at the top of the vertical stem; thereby leaving an upwardly-projecting arm beyond the attachment location.

In an additional aspect of the invention, the frame body is fixedly attached to the base.

In a further aspect of the invention, the frame body is removably attachable to, and detachable from, the base.

In another aspect of the invention, the frame body is threadingly attached to the base.

In an additional aspect of the invention, the frame body is configured with one or more coupling assemblies that enable the detachment of adjacent segments of the frame body to allow the training aid to be stored, transported, and shipped in a smaller configuration.

In a further aspect of the invention, the base is configured with one or more coupling assemblies that enable the detachment of adjacent segments of the frame body to allow the training aid to be stored, transported, and shipped in a smaller configuration.

In an additional aspect of the invention, the tether mount (to which the ball suspension system is connectable) is fixedly attached within the upwardly-projecting arm and/or the downwardly-projecting arm.

In a further aspect of the invention, the tether mount (to which the ball suspension system is connectable) is removably attachable within the upwardly-projecting arm and/or the downwardly-projecting arm.

In another aspect of the invention, the base upright portion and the vertical stem are fitted with corresponding stem height-adjustment devices to allow the ball suspension system to be raised or lowered for players of different heights.

In an additional aspect of the invention, the sections of the vertical stem (support section and upwardly-projecting arm) are fitted with corresponding arm height-adjustment devices to allow the swing opening of the ball suspension system to be increased or decreased to accommodate players of different skill levels.

In a further aspect of the invention, the base is formed of multiple projecting segments or legs.

In an additional aspect of the invention, the base is formed of a hollow container to be filled with fill material.

In another aspect, the base upright portion extends vertically upwardly from a leg joining area of the base at which the legs of the base meet.

In a further aspect, the base upright portion is not vertically aligned with the base but extends vertically upwardly at an offset location and not from the leg joining area of the base.

Another aspect of the present invention is to provide a baseball and/or softball hitting training device that has the ball in line with the centerline of the vertical stem.

An additional object of the present invention is to provide a baseball and/or softball hitting training device that is height-adjustable, so that the ball can be manually positioned at the desired height for the swing practice desired or to accommodate the height of the player.

A further object of the present invention is to provide a baseball and/or softball hitting training device that has a removable and replaceable ball.

These and other objects, features, and advantages of the present invention will become more readily apparent from the attached drawings and from the detailed description of the preferred embodiments which follow.

BRIEF DESCRIPTION OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 1:
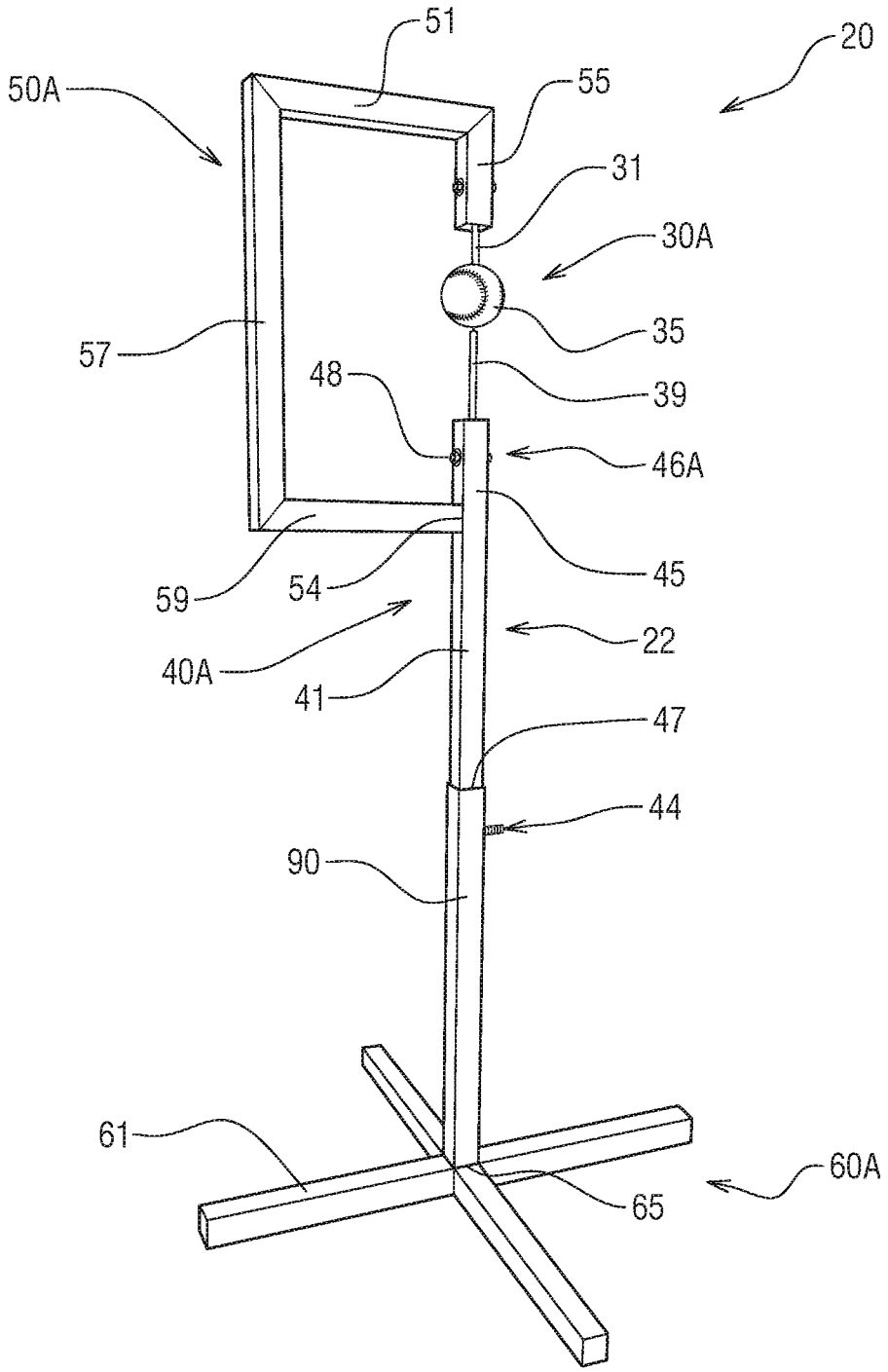
FIG. 1 is a perspective view of a first embodiment of the batting swing training device of the present invention.

Shown throughout the figures, the present invention is directed toward a baseball and/or softball hitting training device that can be used for practice to improve a player's swing and hitting proficiency and that can be converted from a tethered ball device to a tee ball device.

The baseball and/or softball hitting training device, shown generally as reference number 20, is illustrated in accordance with the five embodiments of the present invention. As shown, the baseball/softball hitting training device 20 comprises a base, shown generally as reference number 60; a frame body, shown generally as reference number 40; and a ball suspension system, shown generally as reference number 30.

Figure 14:
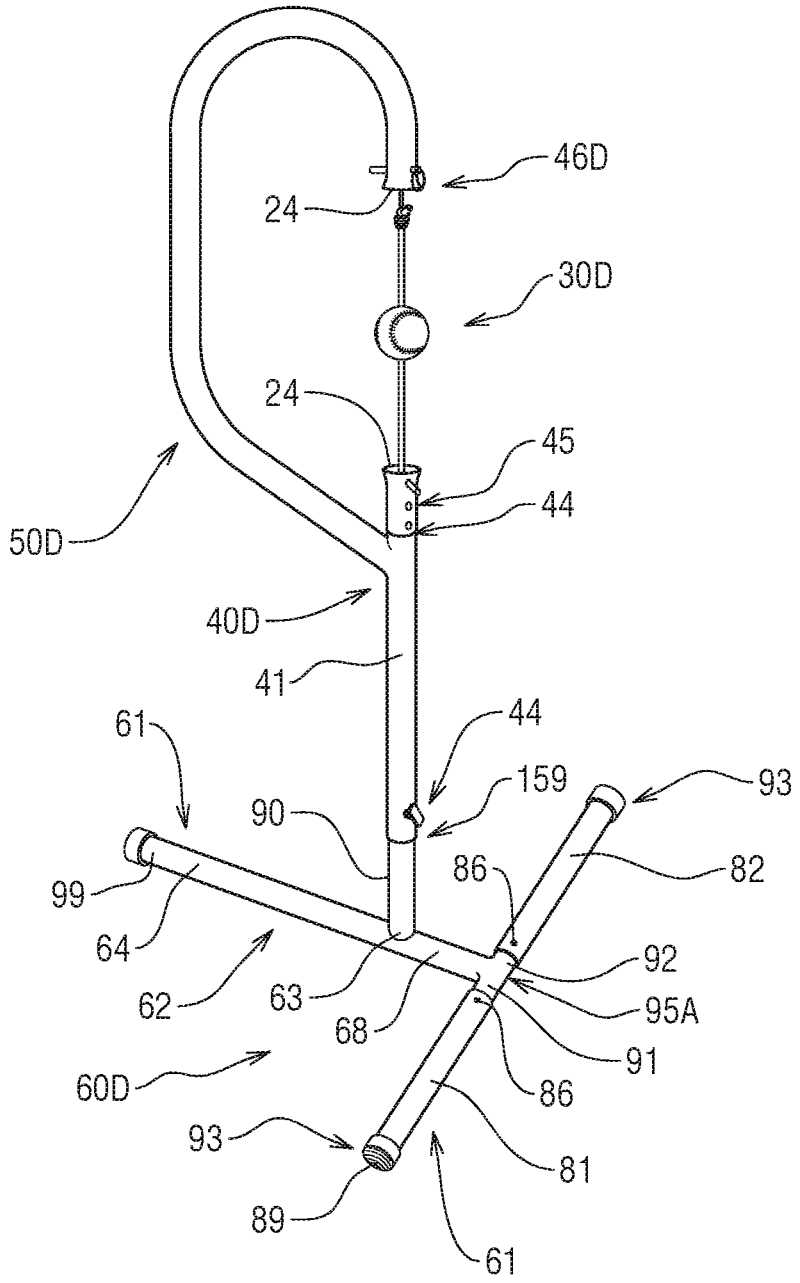
FIG. 14 is a perspective view of a fourth embodiment of the batting swing training device of the present invention arranged in a tethered ball configuration.

The base 60 is configured to support the frame body 40, which, in turn, supports the ball suspension system 30. The frame body 40 comprises a frame vertical stem portion 22 and a frame offset portion 50. The vertical stem 22 comprises a vertically-extending lower stem support section 41 and an upper upwardly-projecting arm 45 in alignment with each other. In some embodiments, the stem support section 41 is formed integrally with, or attached to, the upwardly-projecting arm 45. In the fourth embodiment of FIG. 14, the vertical stem 22 portions (the stem support section 41 and the upwardly-projecting stem arm 45) are joined by an arm height-adjustment system 44. Together the vertical stem 22 and the offset portion 50 support the ball suspension system 30.

The ball suspension system 30 comprises both a ball 35 and a resilient tether 31 onto which the ball 35 is suspended. The ball suspension system 30 is suspended between, and in alignment with, the upwardly-projecting arm 45 of the vertical stem 22 of the frame body 40 and the downwardly-projecting arm 55 of the offset portion 50 of the frame body 40. When in position to be hit, the ball 35 is retained in line with the centerline of the vertical stem 22 and the base upright portion 90, which is a portion of the base 60 that receives the vertical stem 22.

The frame body 40 is height-adjustable via stem height-adjustment device 44, thus allowing the ball 35 to be positioned higher or lower to accommodate the height of the player and/or the particular type of swing to be practiced by the player, such as high or low ball drills. Complementary portions of the stem height-adjustment device 44 are disposed on the stem support section 41 and the base 60, at the juncture of the stem support section 41 and the base 60. Stem height-adjustment device 44 also serves as a coupling assembly to allow the hitting training device to be disassembled into modular components for shipping.

The base 60 is configured to provide stability and steadiness to the baseball/softball hitting training device 20. The base 60A of the first embodiment of FIG. 1 comprises the substantially vertical base upright portion 90 and substantially horizontal leg projections 61 extending outwardly from the leg joining area 65. Though an X-shaped base 60A with four leg projections 61 is shown in FIG. 1, the base 60A may be formed of other numbers of multiple leg projections 61. FIG. 1 also shows the leg projections 61 as having a consistent height and width, i.e., the height and width of each leg projection 61 remains substantially constant from the proximal portion adjacent to the base leg joining area 65 to the distal end portion. But this is not necessary to the invention. For instance, the distal end portions may have a greater width than the proximal portions to provide more stability without having to increase the length of the leg projections 61. The proximal portions of the leg projections 61 of the first embodiment meet at the base leg joining area 65, where they are attached to and support the vertical base upright portion 90. Though the leg projections 61 are shown in FIG. 1 as fixedly attached to the bottom of the base upright portion 90, such as via a weld, seam, adhesive, or the like, the leg projections 61 may be optionally detachable from the base upright portion 90, which serves to increase compactness of the baseball/softball hitting training device 20 for shipping and retail display, as well as for transport between a player's home and ball practice field.

In FIG. 1, the base upright portion 90 projects vertically upwardly from the base leg joining area 65 and is configured to allow the vertical stem 22 to be connected and disconnected. Both the base upright portion 90 and the vertical stem 22 are configured with complementary height-adjustment mechanisms 44 to allow the ball 35 to be raised and lowered to accommodate players of different heights and to facilitate different batting drills.

The lower end of the stem support section 41 is attachable to and detachable from the base upright portion 90 of the base. The offset portion 50 attaches to the upper half of the vertical stem 22 and extends laterally a distance at least one-third the length of a bat to slightly less than the length of a bat, thereby allowing the player to strike the ball 35 with the bat without contacting or impacting the offset portion 50. Though the offset portion 50 is attached to the upper portion of the vertical stem 22, it is not attached at the end of the vertical stem 22, because the upwardly-projecting arm 45 portion of the vertical stem 22 extends upwardly beyond the attachment point of the offset portion 50. The upwardly-projecting arm 45 provides a framework to which the lower portion of the ball suspension system 30 is attached.

The height of the vertical stem 22 and the base upright portion 90 is sufficient to support the ball 35 at a desired height. As illustrated, to provide sufficient extension to allow both high and low hitting drills, one of the vertical stems 22 or the base upright portion 90 will be sized to slide into the other one. In the figures and discussion, the vertical stem 22 is sized to fit into the top edge 47 of base upright portion 90, though the reversed arrangement is also suitable.

The stem height-adjustment system 44 is disposed at the intersection of the base upright portion 90 of the base 60 and the stem support section 41 of the vertical stem 22. And in the fourth embodiment of FIG. 14, an arm height-adjustment system 44 is disposed at the intersection of the stem support section 41 and the upwardly-projecting arm 45. Any height-adjustment system 44 as is known or becomes known in the art is within the scope of the invention. For example, the height-adjustment system 44 may comprise any of the following: the inner section can be configured with a button or buttons that pop out through holes in the outer section to lock (similar to the releasable and engageable coupling mechanism 86 of FIG. 14); the two sections can be configured to be locked in place with a screw or with an offset cam arrangement (the lower height-adjustment system 44 of FIG. 14); the inner section can be configured to be telescoped and then locked in place with a twisting motion that tightens a friction plate against the inner surface of the outer section (the upper height-adjustment system 44 of FIG. 14); the inner section can be configured to be locked in place using a bolt passing through holes that match corresponding holes in the outer section; the inner and outer sections can be configured with corresponding male and female threads; the inner section can be configured with male threads that correspond to female threads in a nut mounted to the outer section via a bearing arrangement; a rack or racks with pinion gear sets can be mounted appropriately at the junction of the two sections; a rope or cable with a winch arrangement can be mounted to adjust the height; a hydraulic cylinder with a spring-mounted piston and relief valves can be installed to provide adjustment; a collar mounted to the outer section that can be tightened to activate a friction lock on the inner section can be used; or any other known height-adjustment system.

In the first embodiment of FIG. 1, the offset portion 50A is an angular C-shape with a proximal end of a generally horizontal offset lower portion 59 joined to the vertical stem 22, with a distal end of the generally horizontal offset lower portion 59 joined to the lower part of a generally vertical offset midsection 57, with the upper part of the generally vertical offset midsection 57 joined to the proximal end of the generally horizontal offset upper portion 51, and with the distal end of the generally horizontal offset upper portion 51 joined to the upper part of the downwardly-projecting arm 55. The tubular downwardly-projecting arm 55 has an interior framework to which the upper portion of the ball suspension system 30A is attached. The joints 54 between the offset portion 50A and the vertical stem support section 41 and between the portions of the angular C-shaped offset portion 50A are permanent connections that may be formed by any known method, such as by welding, adhesives, or the like. In a less preferred aspect, the sections may be removably attachable by any known device to the adjoining section, such as via bolts or pins, to facilitate transport of the baseball/softball hitting training device 20.

Preferably the offset lower portion 59 and the offset upper portion 51 are between 10 and 18 inches in length, and most preferably are 12-14 inches in length. Preferably the offset midsection 57 is between 20 and 30 inches in height, and most preferably 23-28 inches in height. Preferably the upwardly-projecting arm 45 extends from 2 to 10 inches above the attachment location of the offset portion 50 on the vertical stem 22. The separate downwardly-projecting arm 55 may have a length of from 5 to 18 inches but is preferably 8-10 inches.

A tether mount 46A (to which a portion of the ball suspension system 30 will be attached) is disposed within both the upwardly-projecting arm 45 and downwardly-projecting arm 55 at the open ends or preferably a short distance (such as one half to two and a half inches) inside of the open ends. In the first embodiment of FIG. 1, at least a portion of the tether mount 46A protrudes outside of the outer walls of the upwardly-projecting arm 45 and the downwardly-projecting arm 55. In FIG. 1 this tether mount 46A is shown as a nut and bolt 48. The portion of the tether mount 46A that is interior of the outer walls of the arms 45, 55 is a shaft 42, 52 (FIG. 4) to which the upper and lower cord-to-shaft connectors 25 of the ball suspension system 30A are removably attachable.

Figure 7:
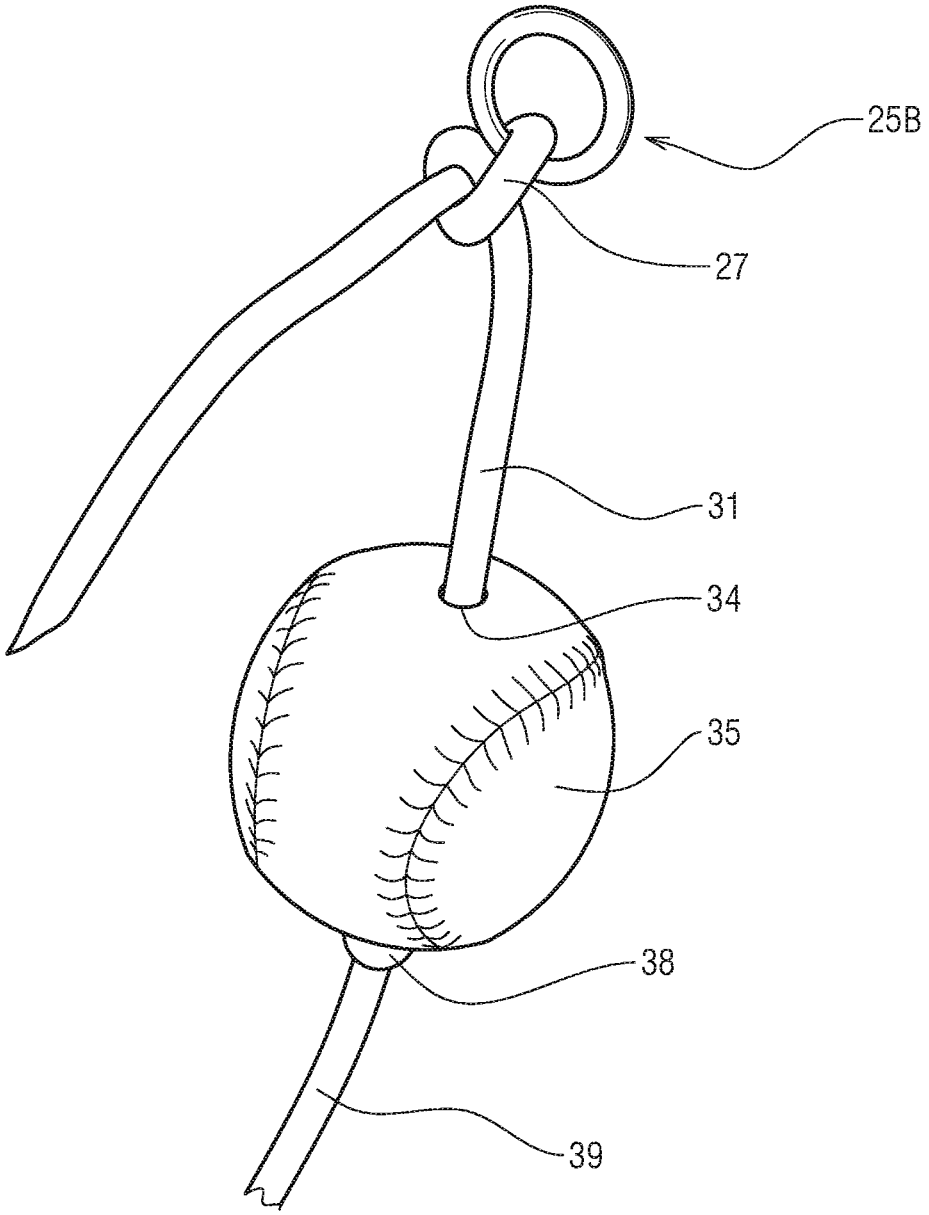
FIG. 7 is a perspective view of the upper portion of the ball suspension system which shows a second aspect of the cord-to-shaft connector, which is suitable for use with the bolt shaft aspect shown in FIG. 5.

The ball suspension system 30A includes the ball 35 supported by and suspended intermedially on a resilient tether 31, with the tether 31 having opposing ends configured with an upper and lower cord-to-shaft connector 25. The upper and lower cord-to-shaft connectors 25 attach to the interior shaft 42, 52 of the lower and upper tether mounts 46. The lower and upper cord-to-shaft connectors 25 may be a connector with an open hook 29 or may be a closed ring-type connector (FIG. 7). The hook-type cord-to-shaft connector 25 may be used with either the removable tether mount 46 (such as the shaft 42, 52 of bolt 48) of FIG. 5 or with the permanently affixed tether mount 46 (such as a shaft that is permanently connected to, or formed integrally with, the external walls) of FIG. 4. If the ball 35 is to be removable, the ring-type connector can only be used with the removable tether mount 46 of FIG. 5, as it can be held in place while the shaft is inserted through it.

Preferably the cord-to-shaft connector 25 is a hook-type connector, such as an eye hook 28 with a safety latch, a carabiner connector, a snap hook with a latch, a scaffold hook, a hook 29 attached via at an articulation device or hinge 23 to a safety latch, or the like. In one aspect of the invention, the cord-to-shaft connector 25 may be a hook-type connector with a swivel incorporated.

Figure 6:
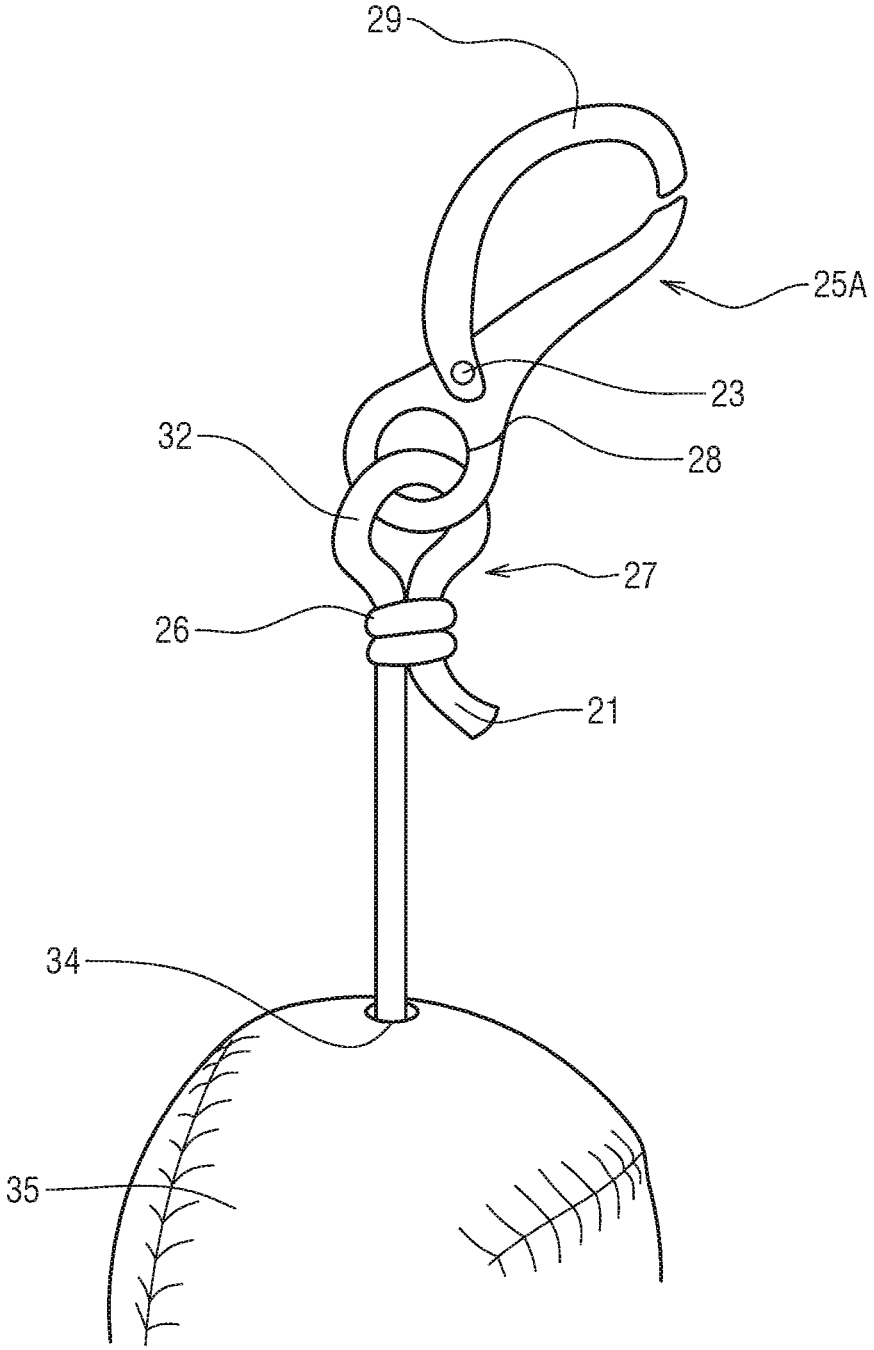
FIG. 6 is a perspective view of the upper portion of the ball suspension system which shows a first aspect of the cord-to-shaft connector, which is suitable for use with the fixedly-attached shaft aspect of FIG. 4 or the bolt shaft aspect of FIG. 5.

A longitudinally resilient, i.e. elastic, cord is used to form the tether 31. Typically, the upper and lower end portions of the tether 31 are attached to the upper and lower cord-to-shaft connector 25, respectively, via a connector securing mechanism 27. Optionally, for a variation in a skill drill, the lower portion of the tether 31 may be unattached with only the top portion of the tether 31 remaining attached. The connector securing mechanism 27 may be as simple as a knot or may be any conventional securing mechanism 27 (for example, rings of metal 26 or another clamping mechanism such is as used to secure a hook to the end of a shock cord). The installation of the connector securing mechanism 27 may create a tether loop 32 that is inserted through an eye 28 (FIG. 6). The connector securing mechanism 27 may be disposed at the ends of the tether 31 or near the ends of the tether 31 with a residual portion 21 of the tether 31 extending beyond the securing mechanism 27. This connector securing mechanism 27 may be permanently or removably attached to the end portions of the tether 31. Permanently attaching the opposing ends of the tether 31 to the cord-to-shaft connectors 25 may be beneficially sturdier and more robust, but when the player needs to replace the ball 35, the entire ball suspension system 30 will necessarily need to be purchased, because the ball 35 cannot be slid off and replaced. Removably attaching the opposing ends of the tether 31 to the cord-to-shaft connector 25 or at least removably attaching the upper end of the tether 31 to the cord-to-shaft connector 25 may allow for replacement of only the ball 35.

Figure 8:
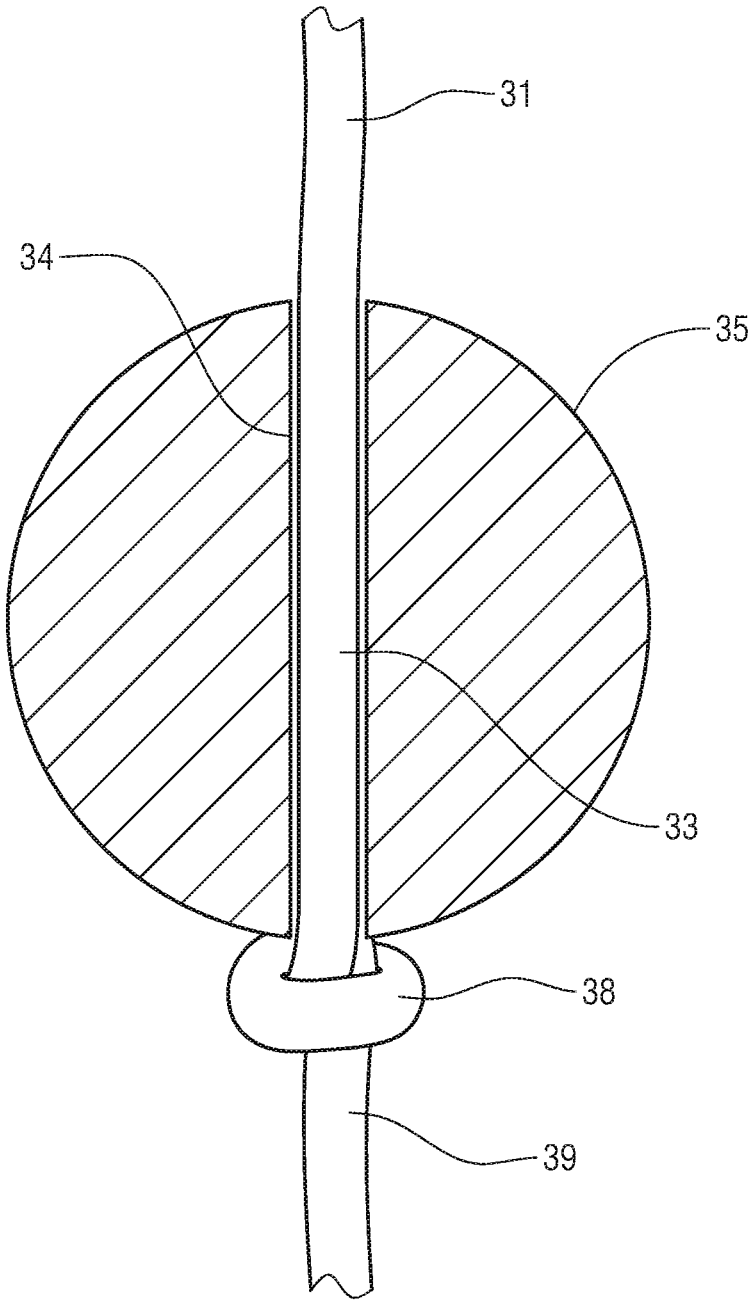
FIG. 8 is a cut view of an aspect of the ball suspension system showing a cord running through a bore in the ball.
Figure 9:
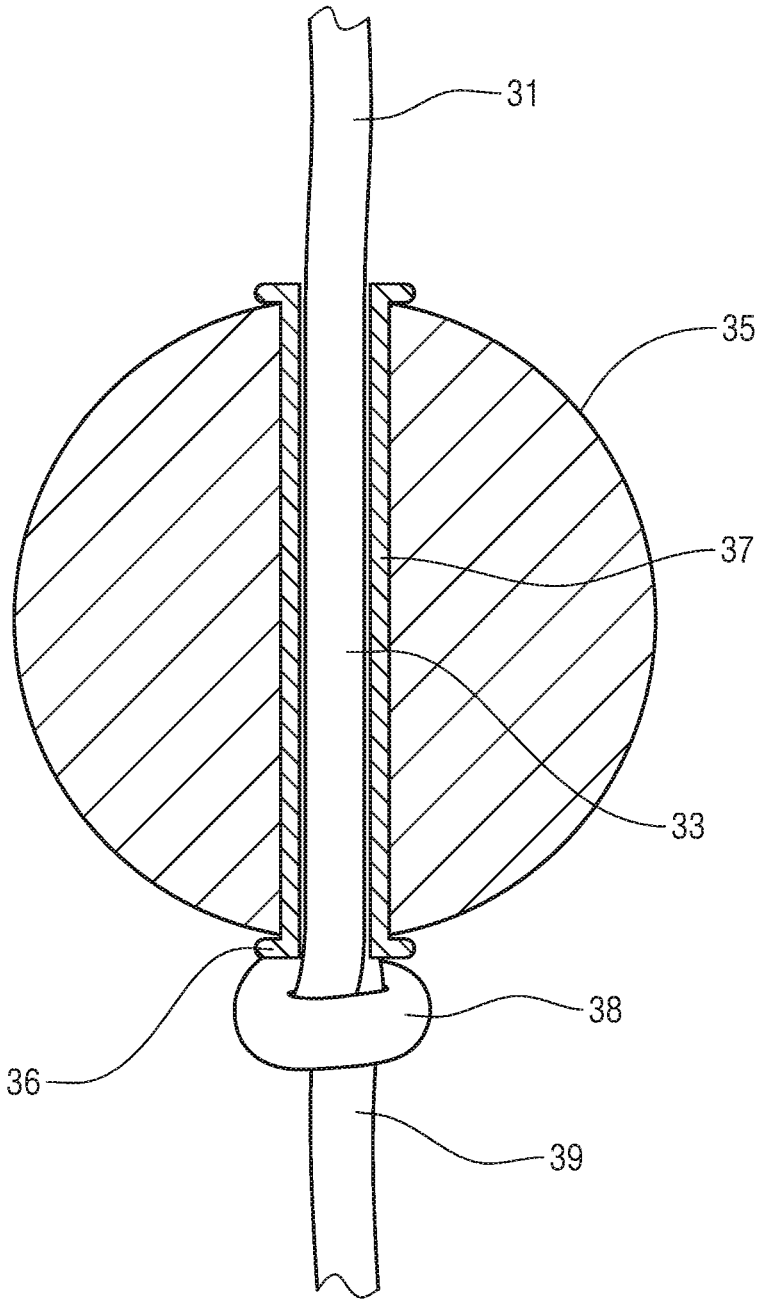
FIG. 9 is a cut view of an aspect of the ball suspension system showing a cord running through a sleeve-lined bore in the ball.

The ball 35 may be a baseball, softball, or other type of conventional sports ball. Ball 35 is configured with a vertically oriented bore defined by bore edges 34 (FIGS. 6, 7, 8) passing from its top surface through to its bottom surface. In one aspect, a center portion 33 of tether 31 is fed through the bore. In another aspect of the invention (shown in FIG. 9) the vertically-oriented bore may be lined with a sleeve 37 with or without flanges 36. The optional sleeve 37 may serve to protect the bore from wear.

The ball 35 may be suspended on the tether 31 via a vertical location restraining mechanism 38. The restraining mechanism 38 serves to hold the ball 35 at a desired vertical location on tether 31 with a tether lower portion 39 extending below the restraining mechanism 38. The restraining mechanism 38 may be as simple as a knot 38 (shown in FIG. 9) or may be a separate apparatus, such as a tightly wound wire, clamp, a yoke that can be tightened, or any other of various conventional clamping, gripping, or clasping devices.

Figure 2:
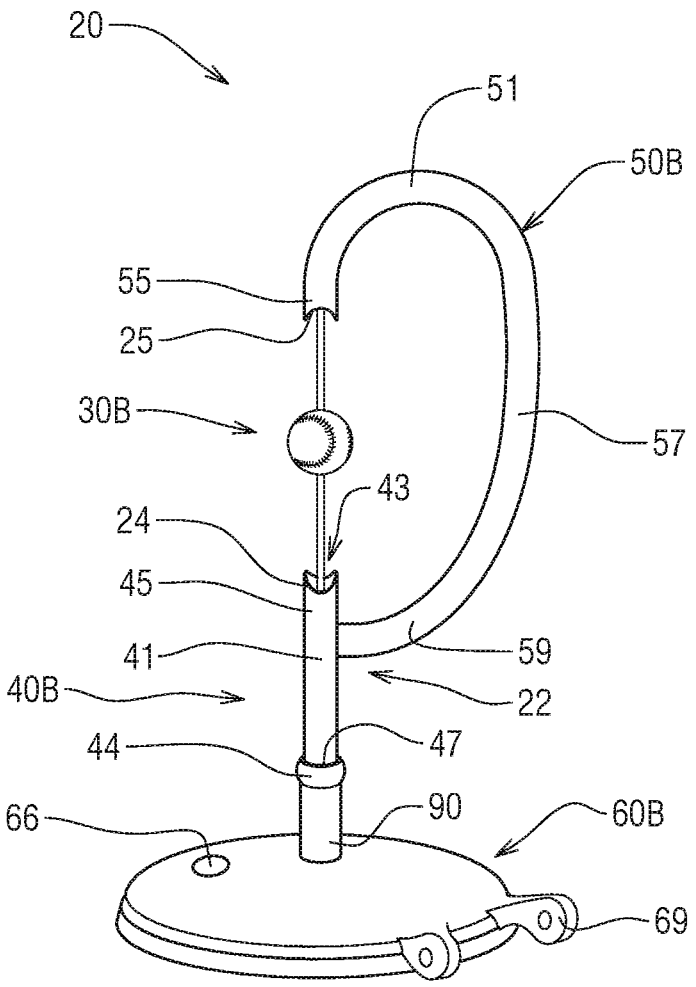
FIG. 2 is a perspective view of a second embodiment of the batting swing training device of the present invention.

The second embodiment shown in FIG. 2, in comparison to the first embodiment, illustrates variations in the base 60B, in the upwardly-projecting arm 45, and in the offset portion 50B.

The fillable base 60B of the second embodiment includes a container with an open interior that can be filled via a removable plug 66 (such as with water or sand) to significantly increase the weight so that the baseball and/or softball hitting training device 20 stays in place. The base 60B has a hollow interior for receiving the fill material. In an aspect shown in FIG. 2, the base 60B may be outfitted with a set of wheels 69 to provide a convenient means of movement of the baseball/softball hitting training device 20. The weighted base 60B may be optionally detachable from the frame body 40 to increase efficiency of transport.

The second embodiment also illustrates that the offset portion 50B need not be angular as in the first embodiment but can have a softened C-shape (as illustrated). The C-shape has a curved lower offset portion 59, a slightly curved midsection 57, and a curved upper offset portion 51 that ends in downwardly-projecting arm 55.

Additionally, the upwardly-projecting arm 45 of the second embodiment of FIG. 2 illustrates a fish mouth top edge 24 in which the portion of the fish mouth top edge 24 in line with the swing is cut lower than the portion of the fish mouth top edge 24 that is not in line with the swing. This provides additional freedom of movement for the tether 31. This is in contrast to the upwardly-projecting arm 45 of the first embodiment (FIG. 1) that has straight top and bottom edges 24, in contrast to the upwardly-projecting arm 45 of the third embodiment (FIG. 3) that has tether end caps 70, and in contrast to the upwardly-projecting arm 45 of the fourth embodiment (FIG. 14) that has a flared top edge 24.

Figure 3:
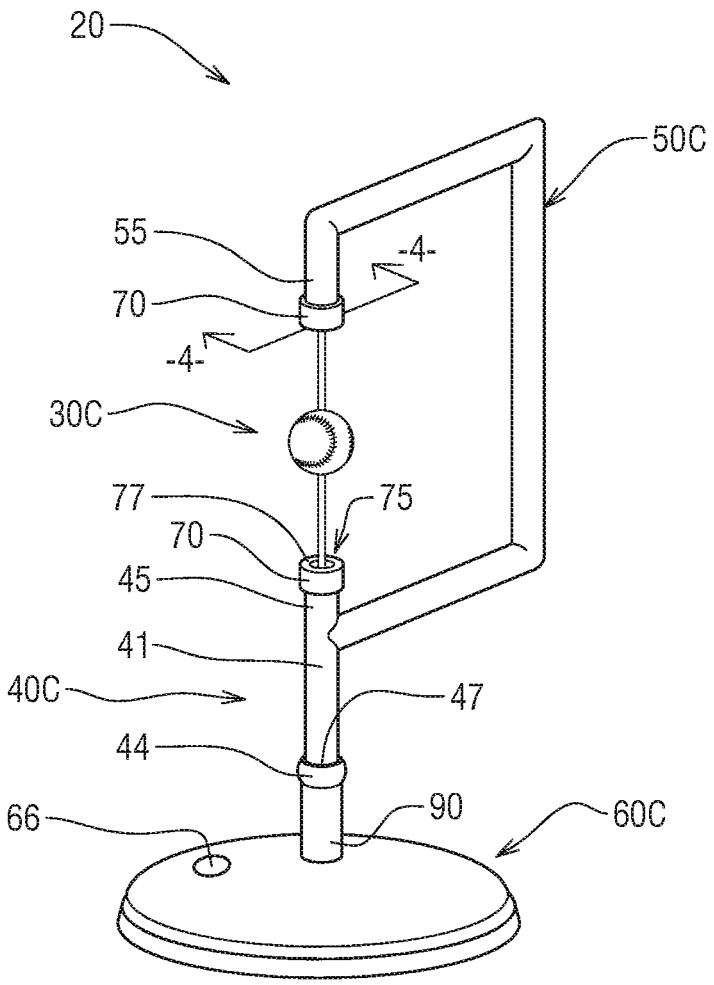
FIG. 3 is a perspective view of a third embodiment of the batting swing training device of the present invention.

The third embodiment illustrated in FIG. 3 is similar in many aspects to the first and second embodiments, but illustrates variations in the base 60C, in the structural material used for the frame body 40C, in the permanently affixed tether mount, and in the inclusion of tether end caps 70.

The base 60C of the third embodiment, like the base 60B of the second embodiment, includes a flattened cylindrical container having a hollow interior for receiving a fill material, such as sand or water, but differs from the base 60B of the second embodiment in that it has no wheels.

The frame body 40C of the third embodiment is angular, as in the first embodiment, but formed of round tubular members, as in the second embodiment and as in the fourth embodiment. The variations shown in the embodiments illustrate that the frame body 40 can be formed of any of a variety of materials having any of an assortment of external form factors. For example, the structural members of the frame body 40C may be formed of PVC pipe having a diameter of from 2 to 4.5 inches or formed of a metal, such as 1 to 2.5-inch square or cylindrical steel or aluminum, which may add sufficient weight to lend stability to the structure during use. Preferably the material has a tubular form, or some other such form as would maximize its strength while being relatively inexpensive to form and use. At least the upwardly-projecting arm 45 and the downwardly-projecting arm 55 of the frame body 40 are tubular so the ball suspension 30 is attachable within the open ends, shown in FIG. 4 as shafts 42, 52 that extend across the interior of the tubular structure.

Figure 4:
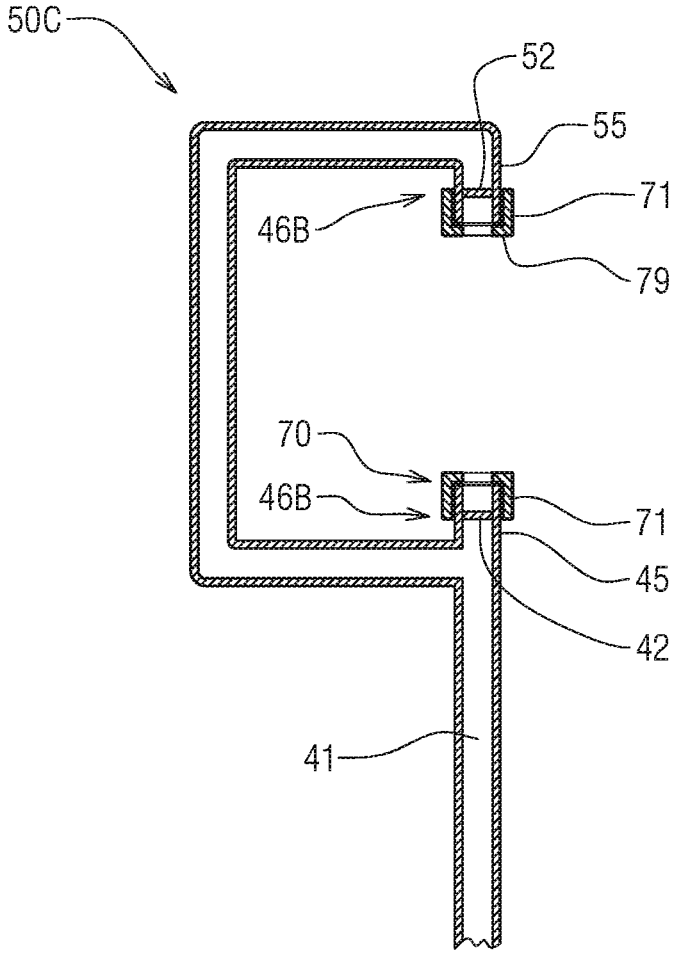
FIG. 4 is a cut view of the upper portion taken along line 4-4 of FIG. 3 showing an aspect of the invention with the ball suspension system removed for clarity of discussion, which shows a tether end cap and interior shafts to which the ball suspension system may be attached.
Figure 5:
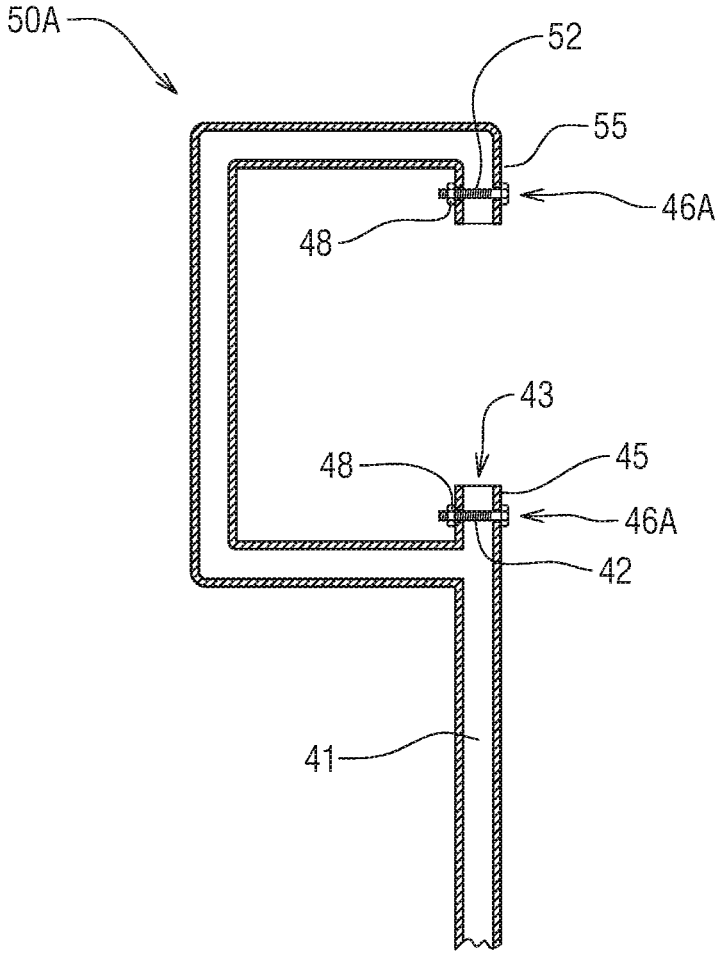
FIG. 5 is a cut view of the upper portion taken along line 4-4 of FIG. 3 showing an aspect of the invention with the ball suspension removed, which shows bolts having a bolt shaft to which the suspension system may be attached.

Additionally, as best seen in FIG. 4, the third embodiment illustrates a permanently affixed tether mount 46B, in contrast to the removable tether mount 46A (nut and bolt 48) of the first embodiment. The permanently affixed tether mount 46B is shown as an upper and lower shaft 42, 52. Shaft 42, 52 is permanently connected to, or formed integrally with, the external walls of the tubular arms 45, 55 of FIG. 4. The upper and lower cord-to-shaft connectors 25 of the ball suspension system 30 are removably attachable to the shaft 42, 52.

Figure 10:
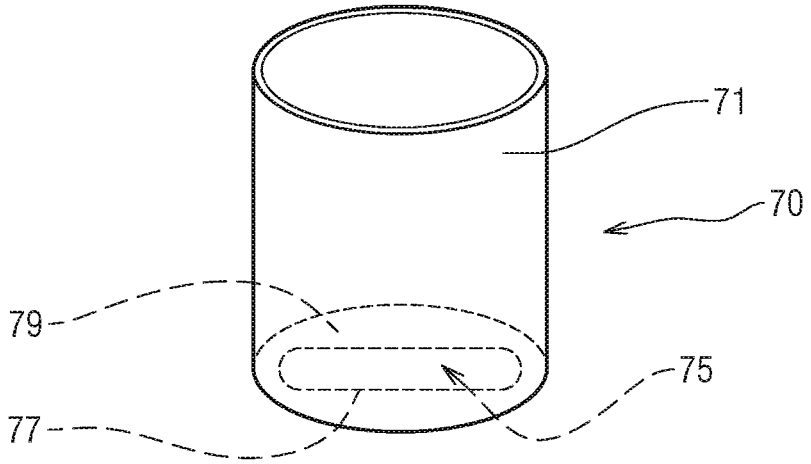
FIG. 10 is a perspective view of a tether end cap of the present invention.

In an aspect shown in FIGS. 3, 4, and 10, a tether end cap 70 is provided to be attached over the open ends of the upwardly-projecting arm 45 and downwardly-projecting arm 55 of the frame body 40. The tether end cap 70 has a shape that generally corresponds to the shape of the upwardly-projecting arm 45 or the downwardly-projecting arm 55 to which it is to be attached. In the illustrated tether end caps, the shape is cylindrical to fit over cylindrical frame tubing. The tether end cap 70 has exterior walls 71 (FIG. 10) of sufficient thickness to retain the end cap 70 in position and of a material that is not brittle and susceptible to cracking upon impact. Each end cap 70 is preferably configured with an open slot 75 (or "coin slot") defined by slot edges 77. The slot 75 is generally thin and oblong with the longer dimension aligned with the direction of the swing of the bat to allow movement of the elastic tether 31 within the slot 75. Thus, the slot-end 77 of the end cap and the opposing end of the end cap both have an opening. The slot of the slot-end of the end cap receives a portion of the tether 31. The opposing end is sized and shaped to accommodate the open end of the upwardly-projecting arm 45 or the downwardly-projecting arm 55 to which it is to be attached.

The tether end cap 70 may be attached permanently or removably. It is preferred that the end cap 70 be removably attached to allow for replacement in case of damage from misplaced bat impacts. The removably attachable end cap may be frictionally engaged, threadingly engaged, or secured by a securing mechanism. The preferred material to form the tether end cap 70 is a natural or man-made material characterized by strength and ductility that withstands both stress and strain by absorbing energy and plastically deforming without fracturing. Non-limiting examples are polyurethane and other plastics, rubber, and NINJA FLEX® and other thermoplastic polyurethanes.

In a further aspect, the baseball/softball hitting training device 20 may additionally comprise a batting tee insert 80 to enhance the usability of the device 20 and to increase the types of hitting drills that can be performed with the device 20. To use the batting tee insert 80 (FIGS. 11, 12, 13), the vertical stem 22 (with the attached offset portion 50) is removed from the top of the base upright portion 90 of the base 60. The lower end 87 of the batting tee 80 is then inserted into the top end 47 (FIG. 1) of the base upright portion 90.

Figure 11:
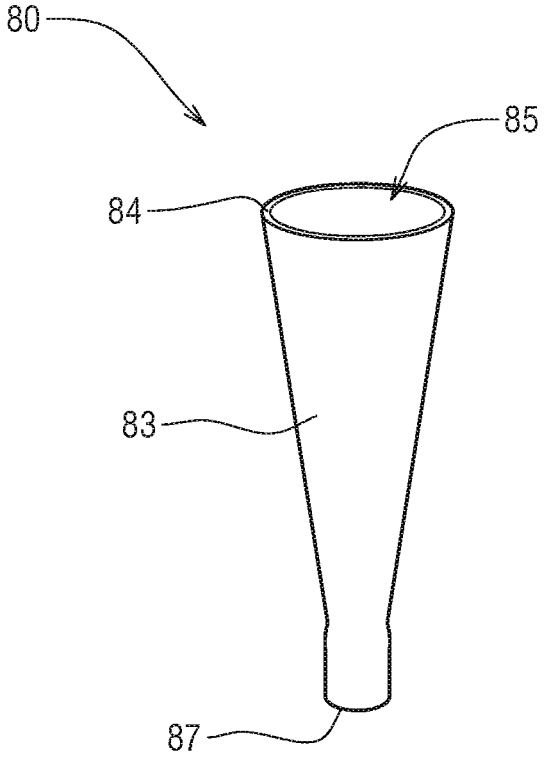
FIGS. 11-13 are aspects of an optional separate batting tee insertable into, and usable with, the batting swing training device of the present invention.
Figure 12:
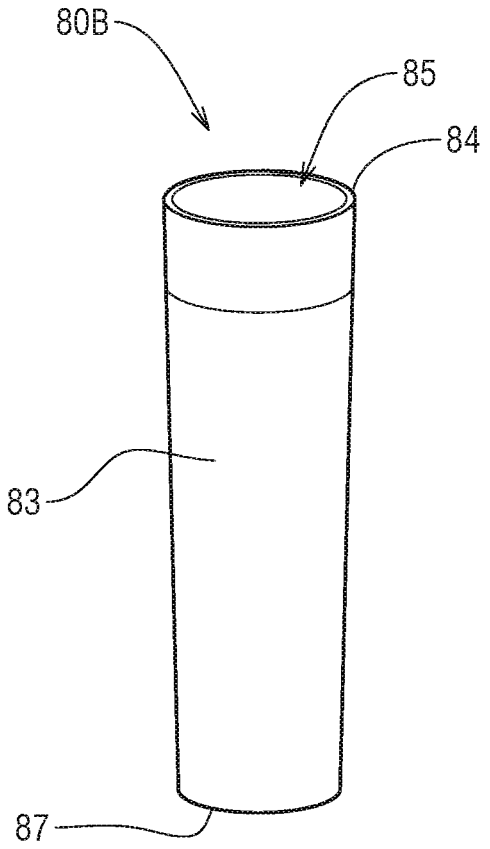
Figure 13:
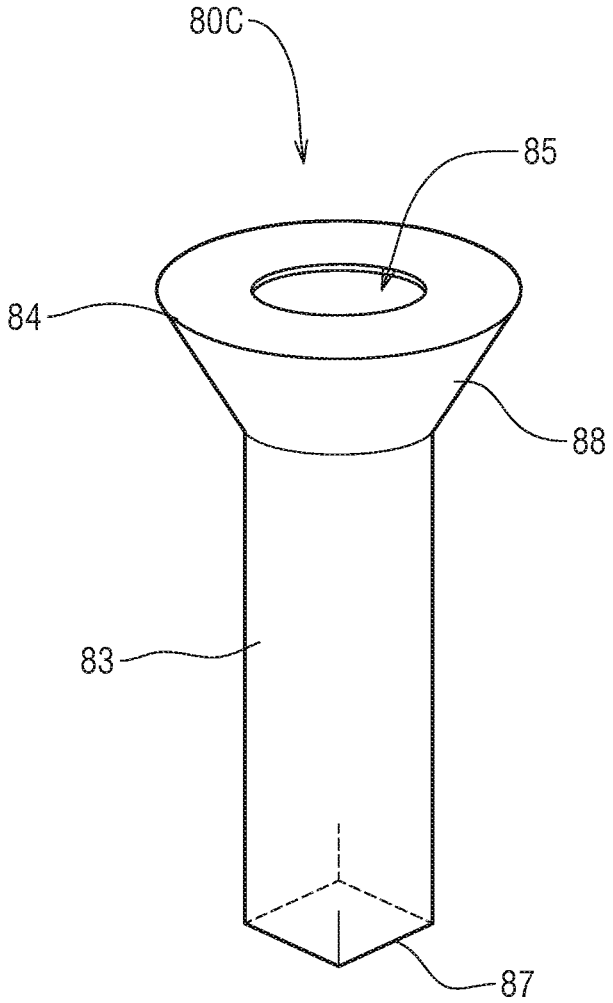

Any of various types of batting tee inserts (80A, 80B, 80C) may be used, exemplary ones of which are illustrated in FIGS. 11, 12, 13. All the exemplary batting tee inserts have a ball-receiving upper portion 85 with a generally circular upper opening for holding the ball 35 in position to be hit. The walls of the ball-receiving upper portion 85 may be thinner, as seen in the wall edge 84 in FIGS. 11-12, or thicker, as in the wall edge 84 in FIG. 13. FIG. 11 shows a cone-shaped batting tee insert having side walls 83 in a cone shape; FIG. 12 shows a cylindrical batting tee insert with cylindrical side walls 83; FIG. 13 shows a square-to-round conversion batting tee insert with the lower end 87 configured to correspond to a frame 40 formed of a square tubing material, with cylindrical upper side walls 83 supporting a truncated cone-shaped side wall 88 ending in the ball-receiving portion 85.

Figure 15:
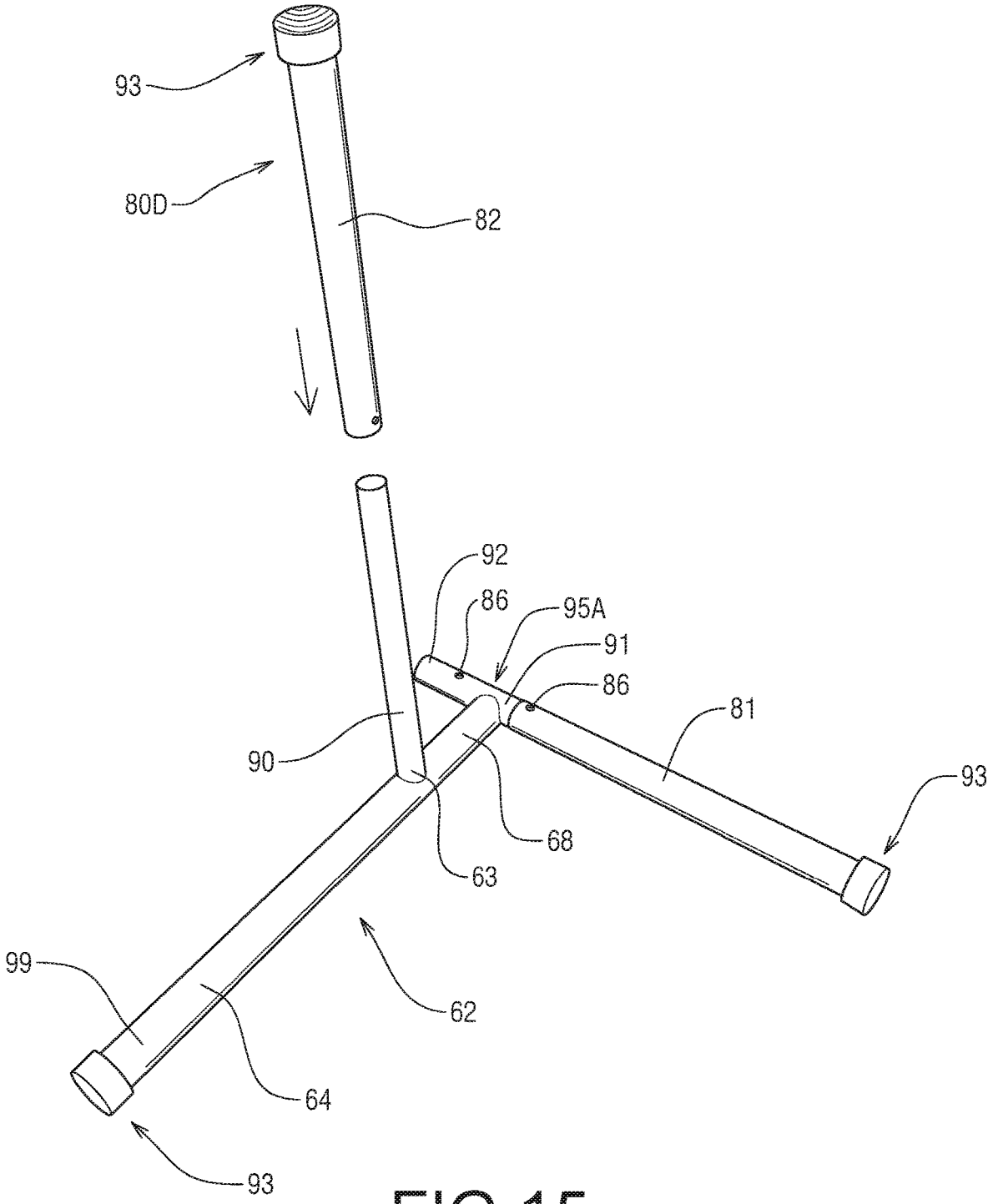
FIG. 15 is an expanded perspective view of the fourth embodiment of the batting swing training device of the present invention in the process of being converted to a tee ball configuration.
Figure 16:
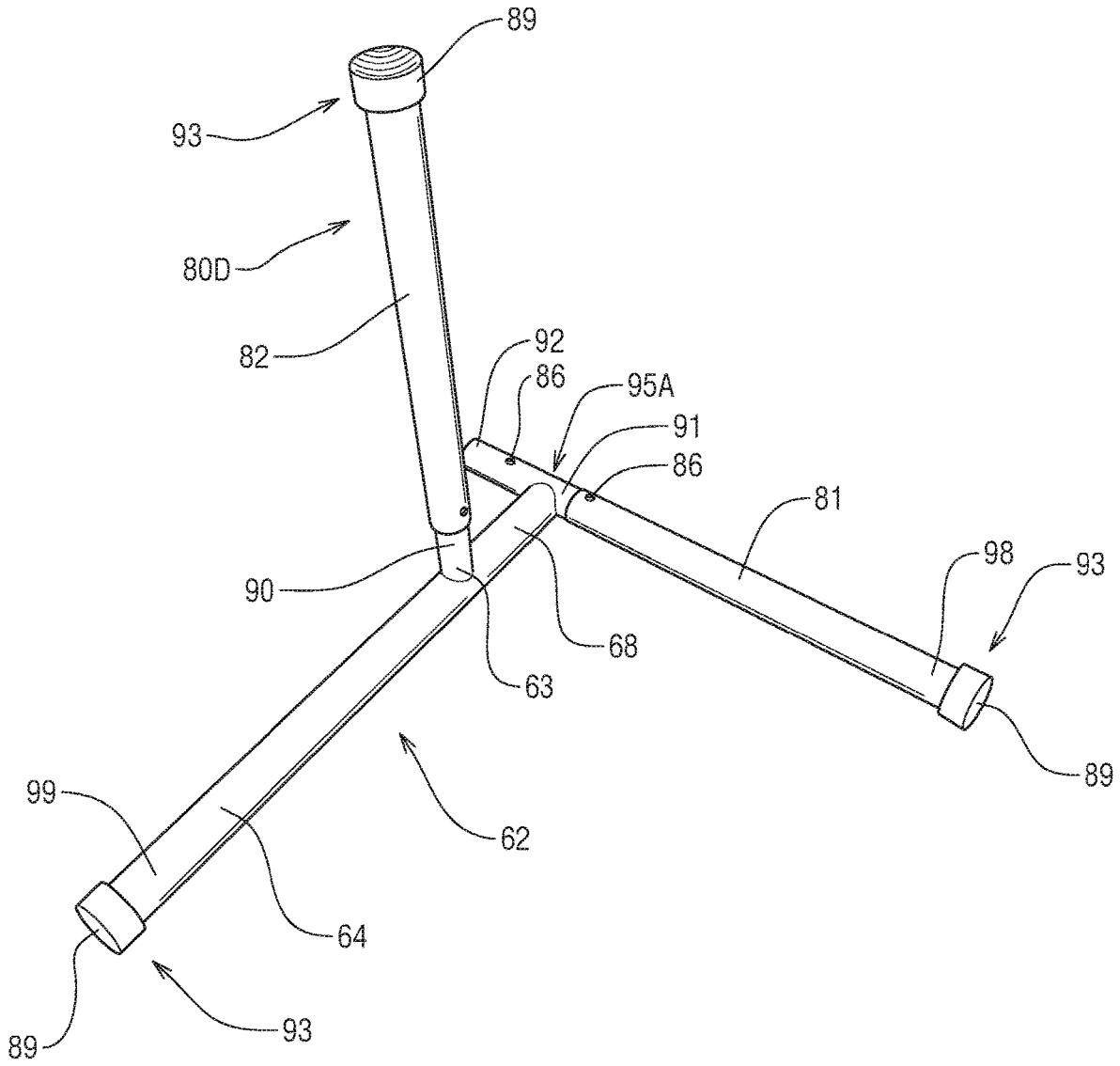
FIG. 16 is a perspective view of the fourth embodiment of the present invention arranged in a batting tee configuration.

The fourth embodiment, as seen in FIGS. 14-17, illustrates variations in the base 60D, in the ball suspension system 30D, in the frame body 40D, and in the conversion tee 82 (FIGS. 15-16).

The offset base 60D of the fourth embodiment comprises three leg projections 61 instead of the four leg projections 61 of the first embodiment, and the attachment point for the base upright portion 90 is not at a central leg joining area 65 (as in the first embodiment) but is instead at an offset junction point 63.

The three leg projections 61 of the offset base 60 include two connectional legs 81, 82 and one somewhat longer foundational leg 62. The foundational leg 62 comprises a bracing portion 64 aligned with an intermediary portion 68, a perpendicular base portion 95A (perpendicular to the aligned bracing and intermediary portions), and an attached base upright portion 90. The bracing portion 64 extends longitudinally along the x axis from the distal end 99 to the opposing T-shaped or perpendicular portion 95A with the upwardly-extending base upright portion 90 attached within the proximal half of the foundational leg 62 (proximal to the connectional legs 81, 82). The base upright portion 90 extends at a perpendicular angle to the bracing portion 64 and the intermediary portion 68 in the z axis. The perpendicular portion 95A is attached to the proximal end of the foundational leg 62, and that has two arms, the two tubular T-extensions 91, 92. The two tubular T-extensions 91, 92 are perpendicular to the foundational leg 62 in the y axis. Preferably the length (in the y direction) of the two tubular T-extensions 91, 92 may be from 7 to 25 inches, but is most preferably 10 to 15 inches. The connectional legs 81, 82 may have a length of between 8 and 30 inches but are preferably between 18 and 22 inches.

The intermediary portion 68 is disposed between the perpendicular portion 95A and the junction 63 at which the base upright portion 90 attaches to the foundational leg 62. The bracing portion 64 of the foundational leg 62 is preferably integrally formed with, or fixedly connected to, the intermediary portion 68. The intermediary portion 68 is preferably integrally formed with, or fixedly connected to, the perpendicular portion 95A and the bracing portion 64. The length of the intermediary portion 68 is less than half the total length of the foundational leg 62 and is preferably 10 to 40% of the total length of foundational leg 62. Together the intermediary portion 68 and the bracing portion 64 may be from 22 to 36 inches in length but are preferably 25 to 29 inches in length.

The base upright portion 90 is disposed along the top of the foundational leg 62, attaching at offset junction point 63, and is disposed within the proximal half of the foundational leg 62, where the proximal half is the half nearer to the perpendicular portion 95A. The base upright portion 90 may be fixedly connected to, integrally formed with, or removably attached to, the foundational leg 62, but preferably is fixedly connected. The top of the base upright portion 90 receives the frame body 40D.

The perpendicular 95A illustrated is a double male T-connector, though a male-female T-connector or double female T-connector may be used. The outward end of the first T-extension 91 connects to the first connectional leg 81. The outward end of the second T-extension 92 connects to the second connectional leg 82. With the double male connector shown, the open ends of the connectional legs 81, 82 receive the T-extensions 91.

At least one of the two connectional legs 81, 82, and preferably both connectional legs 81, 82, are removable from the first and second T-extensions 91, 92, respectively, by utilization of a coupling and de-coupling mechanism 86. Preferably, a releasable and engageable coupling mechanism 86 is disposed between the outward end of the first T-extension 91 and the inner end of the first connectional leg 81; and a releasable and engageable coupling mechanism 86 is disposed between the outward end of the second T-extension 92 and the inner end of the second connectional leg 82. The releasable and engageable coupling mechanism 86 may be the same type of device as the height-adjustment mechanism 44 or the releasable and engageable coupling mechanism 86 and the height-adjustment mechanism 44 may be different types of devices. The releasable and engageable coupling mechanism 86 shown in FIGS. 14-17 are depressible buttons 49 (FIG. 20) of pin 78 that interact with holes in the corresponding part, but other releasable and engageable coupling mechanisms are suitable.

Figure 17:
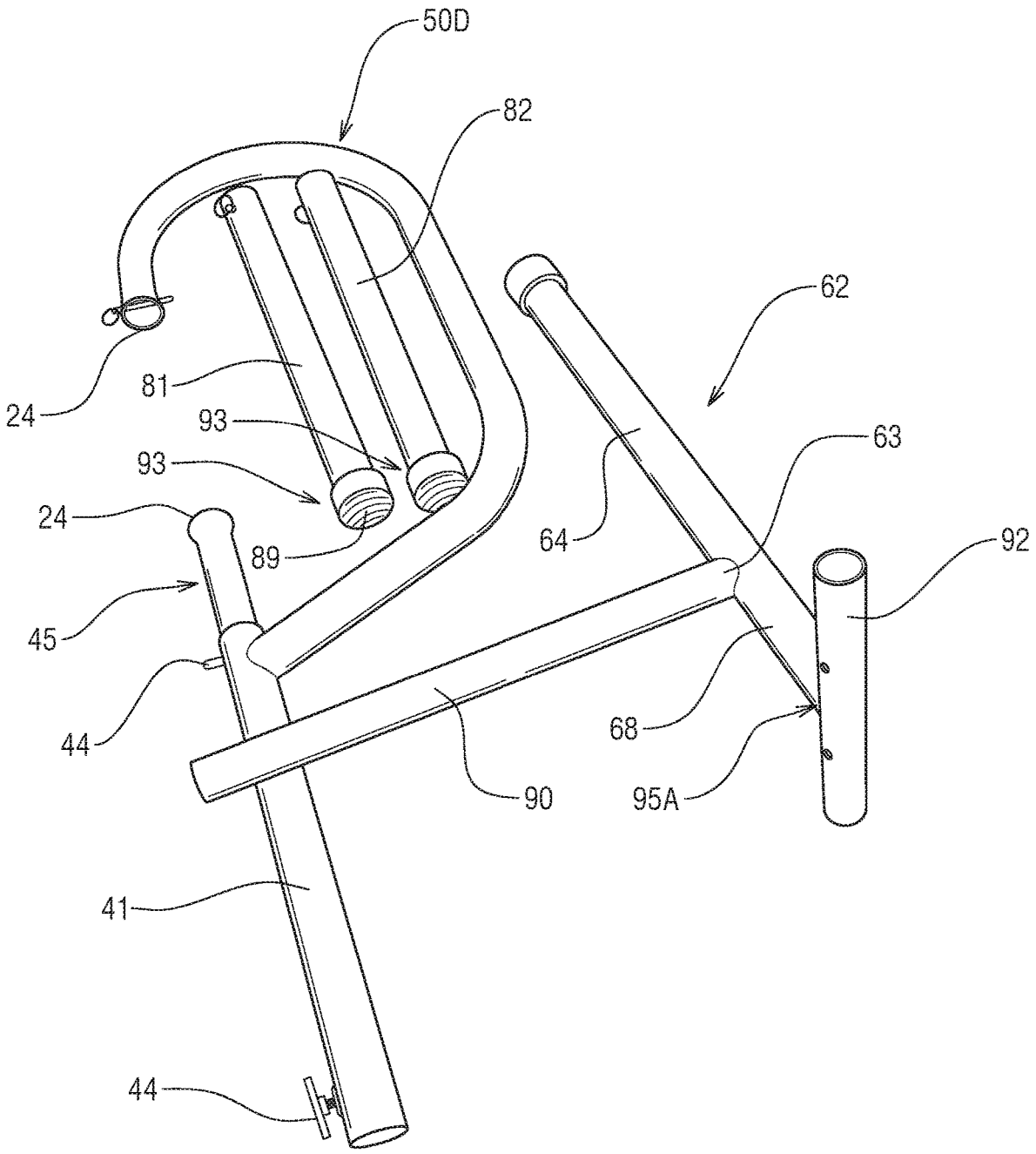
FIG. 17 is a perspective view of the fourth embodiment of the present invention in which most sections are disconnected, such as for shipping or transport.

At least one of the two connectional legs 81, 82, and preferably both connectional legs 81, 82 and the foundational leg 62, are fitted with a leg end cap 93, which may be attached permanently or removably, but is preferably removable and replaceable. The leg end cap 93 is configured with an interior surface sized to frictionally engage the outer surface of the connectional leg 81, 82 and foundational leg 62. The end cap 93 is further configured with a concave outer surface 89 (FIG. 17). The end cap 93 serves two purposes. First, it serves as a termination or closure to the distal open tubular end of the connectional legs 81, 82 and foundational leg 62 for increasing safety and the overall aesthetic look of the device. Second, one connectional leg 81, 82 can be disengaged from the perpendicular portion 95A of the foundational leg 62 and can be inserted into the base upright portion 90 to serve as an upwardly-projecting batting tee onto which a standard baseball or softball may be placed. The ball 35 is rested on the concave surface 89 of end cap 93.

In this fourth embodiment, to convert the batting swing training device to a tee-type device, the user removes one of the first or second connectional legs 81, 82 from the corresponding first or second T-extension 91, 92. This removed connectional leg 81, 82 is then connected to the top of the base upright portion 90 of the base 60, as shown in FIGS. 15-16. As shown in FIGS. 15-16, the remaining T-extension 92, the connectional leg 81, and the foundational leg 62 remain horizontal on the ground to support the tee-type device created by the insertion of the leg 82 into the top of the base upright portion 90 of the base 60. The concave surface 89 of the top of the terminal cap 93 of the leg 82 is sufficiently deep to accommodate a ball positioned in the concavity 89 but shallow enough to allow the ball to be hit off the tee-type device.

Figure 18:
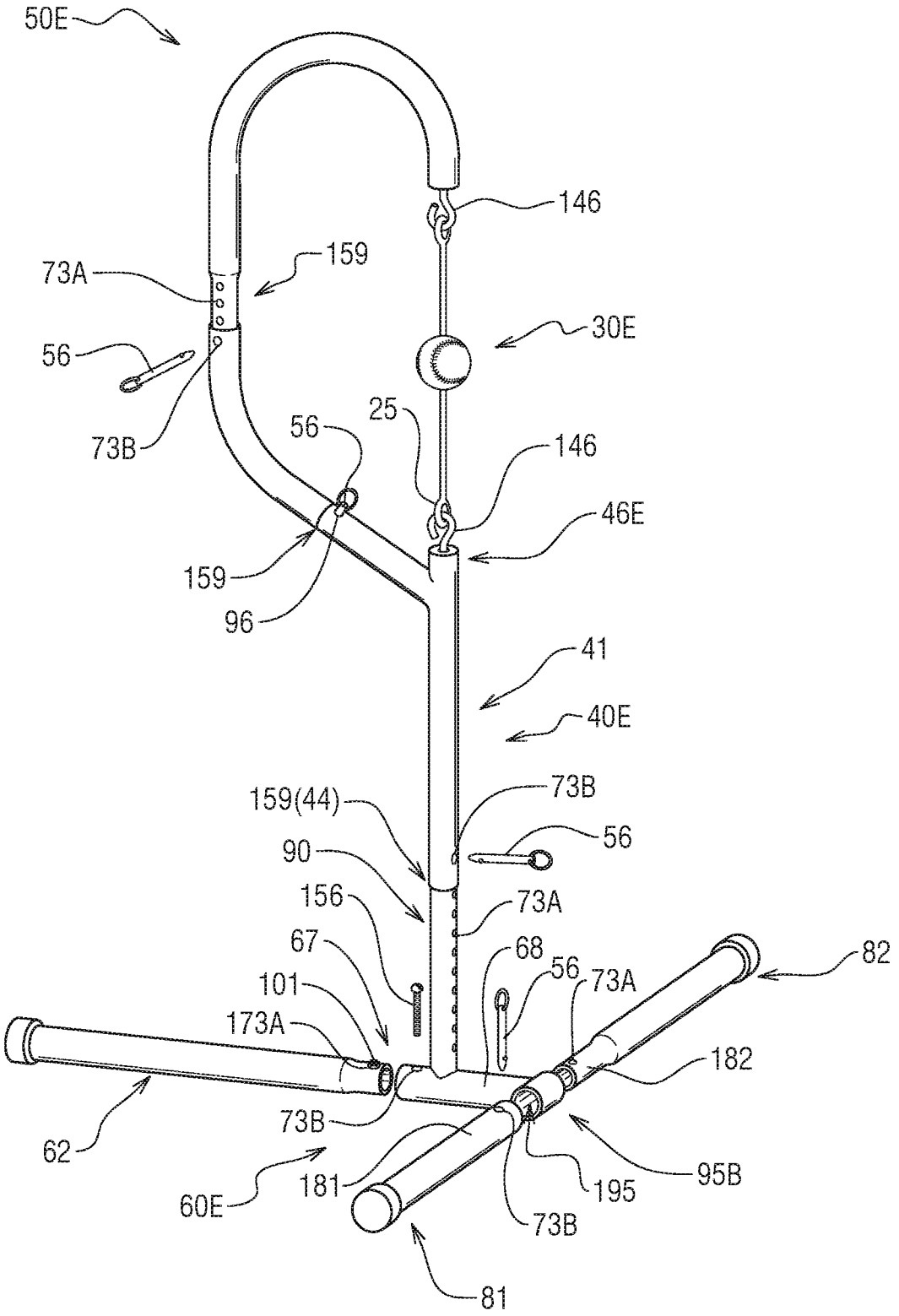
FIG. 18 is a perspective view of a fifth embodiment of the batting swing training device of the present invention arranged in a tethered ball configuration.
Figure 19:
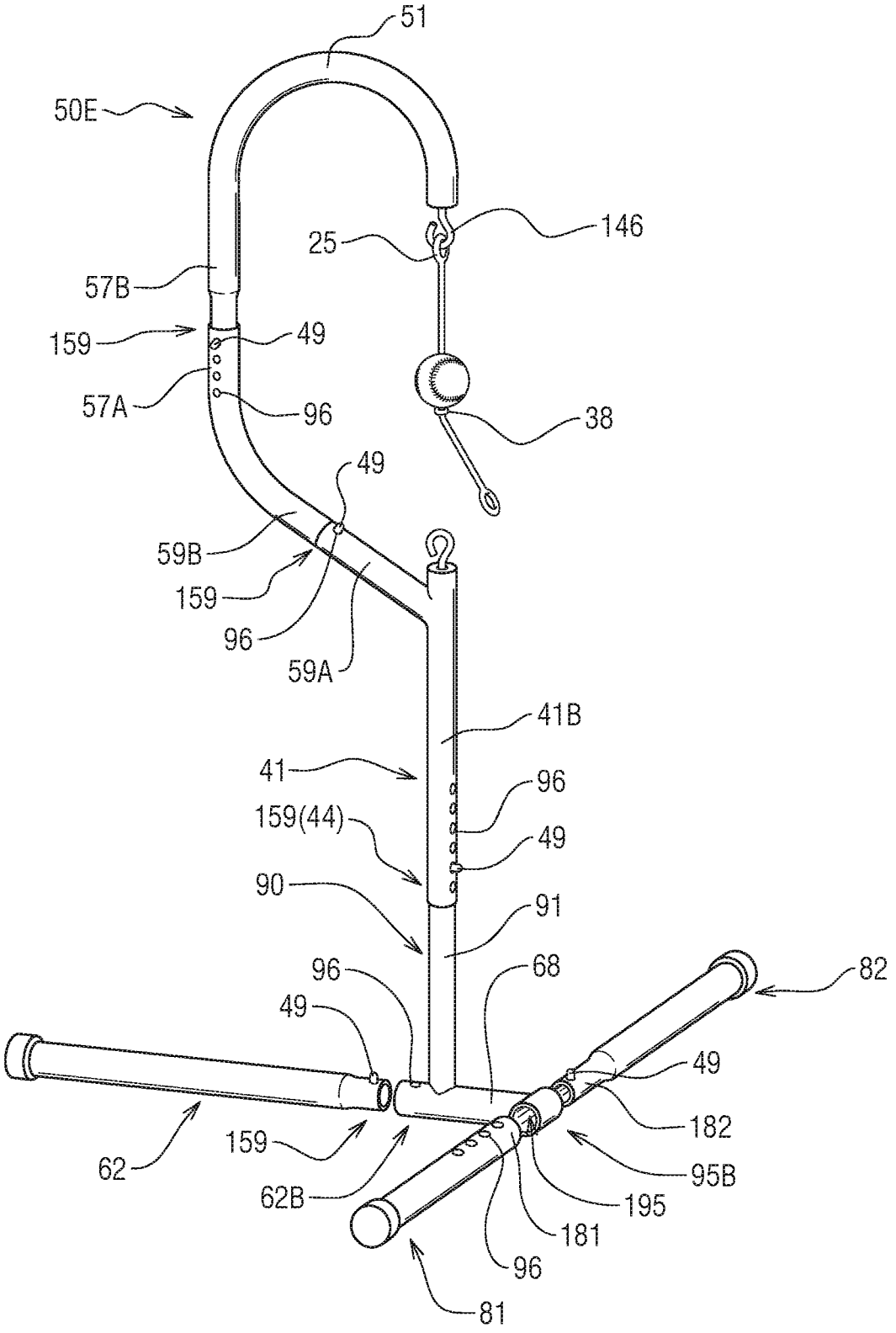
FIG. 19 is a perspective view of a sixth embodiment of the batting swing training device of the present invention arranged in a tethered ball configuration.

The preferred fifth embodiment, as seen in FIGS. 18-19, shares some similar elements to the elements of the first four embodiments, but particularly illustrates variations in the frame body 40E, in the base 60E (such as the addition of a tunnel-type perpendicular connector 95B), in the ball suspension system 30E, in adding the coupling 159 means of connecting adjacent segments of the training aid 20, and in the connectional leg 81 that can be used as a conversion tee.

The fifth embodiment provides multiple coupling assemblies 159 to easily attach and detach adjacent segments of the training aid to reduce the overall dimensions of the training aid 20 during shipping, retail display, transport, and storage. The attachable and detachable coupling assemblies 159 include couplings in the offset portion 50E, in the frame body 40E, and in the base 60E. The inclusion of these coupling assemblies 159 provides numerous advantages. Disassociating adjacent segments allows the training aid 20 to be shipped in a smaller box to reduce shipping costs, reduces shelf space required during retail distribution, allows the end user to transport the training aid 20 to a sports training facility or back home in a smaller vehicle, and enables the end user to more conveniently store the disassembled training aid 20.

In one aspect of the invention shown in FIG. 18, each of the multiple coupling assemblies 159, which function to connect adjacent segments of the training aid 20, comprises one or set of spaced holes defined by hole edges 73B (FIG. 18) that can be manually aligned with a corresponding hole defined by hole edges 73A. After alignment of a selected hole defined by hole edges 73B with the corresponding hole on the adjacent segment, the holes can be fixed in the aligned position by insertion of a pin 56 or by insertion of a threaded connector 156. If the threaded connector 156 is to be used, a nut 101 may be fixedly attached (such as by welding or adhesive) at the location of hole 73B. The set of holes defined by hole edges 73B may be on either of the adjacent segments with the corresponding hole defined by hole edges 73A disposed on the other adjacent segment.

In another aspect of the invention shown in FIG. 19, each of the multiple coupling assemblies 159, which function to connect adjacent segments of the training aid 20, comprises a set of spaced holes defined by hole edges 96 (FIG. 19), a corresponding hole defined by hole edge 58 (FIG. 20), and a spring clip 78 with at least one button 49. The spring clip 78 is disposed within the interior of the segment with the button 49 extending through the corresponding hole defined by hole edge 58. In this aspect, the button 49 disposed within corresponding hole defined by hole edges 58 is depressed so that one of the set of spaced holes defined by hole edges 96 can be manually aligned to allow button 49 to spring into the selected hole defined by hole edges 96, which fixes the holes in the aligned position. The set of holes defined by hole edges 96 may be on either of the adjacent segments with the corresponding hole defined by hole edge 58 and carrying button 49 disposed on the other adjacent segment.

In addition to the advantages in disassociation at the coupling assemblies 159 for shipping, retail sales, transport, and shipping, at least some of the coupling assemblies 159 provide advantages during use of the training aid 20. For example, the coupling assembly 159 at the center of the C-shape of the offset portion 50E allows the open space above and below the ball 35 to be increased to accommodate swing training for less proficient users or to be decreased for more proficient users. In a second example, the coupling assembly 159 between the stem support section 41 and the base upright portion 90 allows the training aid 20 to be adjusted in height and serves the function of the stem height-adjustment system. In this example, a hole can be selected that positions the ball 35 at a higher or lower position, such as to match the height of the user.

Additionally, the fifth embodiment of FIGS. 18-19 provides a tunnel connector 95B that allows the connectional legs 81, 82 to be easily attached and detached. This not only reduces the overall dimensions of the training aid 20 for shipping, retail display, transport, and storage, but also provides the advantage that connectional leg 81 may be disassociated and repositioned as a conversion tee by connecting the proximal end 181 of the connectional leg 81 of the top of base upright portion 90, as shown in FIG. 16.

The tunnel connector 95B comprises a tubular channel 195 affixed perpendicularly to the proximal end of intermediary portion 68 of the foundational leg 62. The channel has an open interior space defined by the outer walls of the tunnel connector 95B, which is sized to accommodate connectional leg 82, which is slid into, and through, the open channel 195 and engaged with connectional leg 81. In the aspect shown in FIG. 18, corresponding holes defined by hole edges 73A, 73B are aligned and a pin 56 is inserted into the aligned holes. In the aspect shown in FIG. 19, the proximal portion 182 of the connectional leg 82 passes through the tubular channel 195 sufficiently far to dispose button 49 on the same side of the tunnel connector 95B as the connectional leg 81. A hole defined by hole edges 96 on leg 81 is manually aligned with and receives button 49 of leg 82. The spring button 49 protrudes into the hole defined by hole edges 96 of leg 81 to fix the legs 81, 82 together to the side of (or within) the tubular channel 195. Optionally, the button 49 may extend further into an interior hole or a through-hole in the outer wall of the tunnel connector 95B.

In an aspect shown in FIG. 18, the first connectional leg 81 is configured with a first hole-1 defined by first hole edge 73B and the second connectional leg 82 is configured with a second hole-1 defined by second hole edge 73A. In another aspect, the holes 73A, 73B are cut through both sides of the legs 81, 82. The first connectional leg 81 is configured with a first hole-1 and with an opposing first hole-2 (not seen in the orientation of FIG. 18) on the opposite side of the first connectional leg 81 both defined by first hole edges 73B, the second connectional leg 82 is configured with a second hole-1 and with an opposing second hole-2 (not seen in the orientation of FIG. 18) on the opposite side of the second connectional leg 82 both defined by second hole edges 73A.

To assemble the device of FIG. 18, the second connectional leg 82 is fitted through the open channel 195 of the tunnel connector 95*b* with the end 182 extending through the open channel 195. The first connectional leg 81 is fitted over the end 182 of the second connectional leg 82. The first hole or set of first holes defined by first hole edge 73B and the second hole or set of holes defined by second hole edges 73A are aligned. Then pin 56 is inserted at into the first hole defined by first hole edge 73B and into second hole defined by second hole edges 73A. Optionally, but preferably, opposing holes are disposed on the opposite sides of each leg 81, 82 and pin 56 is also inserted through the open interior space of open channel 195 and on through the opposing holes. In an optional aspect, the tunnel connector 95B is also configured with a connector hole or a set of connector holes, and the pin 56 may be inserted through connector hole-1, then through the first hole-1, then through the second hole-1, then through interior space of open channel 195, then through second hole-2, first hole-2, and through connector hole-2.

Figure 20:
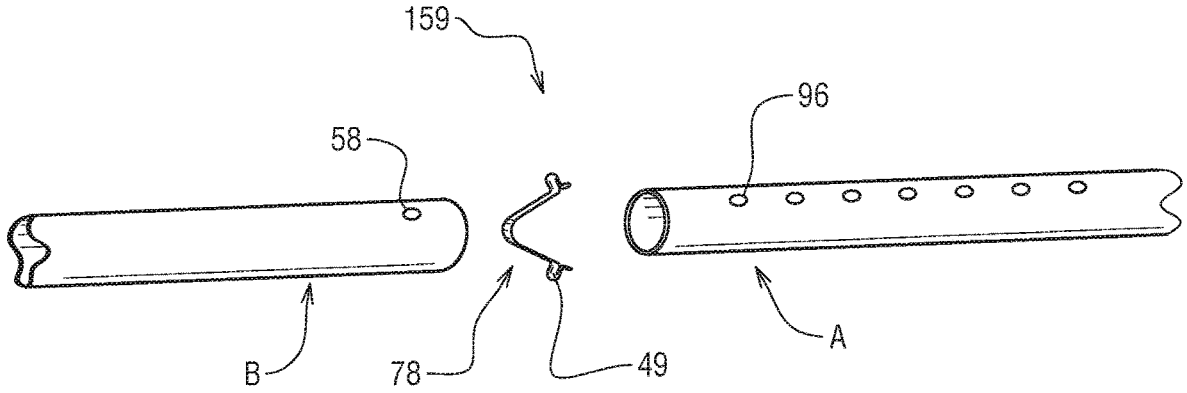
FIG. 20 is an expanded perspective view of a coupling assembly with an internal double pin of the fifth embodiment of the batting swing training device of the present invention.

The hitting training device of FIG. 19 is assembled similarly. The second connectional leg 82 is fitted through the open channel 195 of the tunnel connector 95*b* with the end 182 extending through the open channel 195. The first connectional leg 81 is fitted over the end 182 of the second connectional leg 82. A selected hole of the set of first holes defined by first hole edge 96 is aligned with the hole 58 (FIG. 20) through which button 49 protrudes. Button 49 is engaged into the selected first hole defined by first hole edge 96. Optionally, but preferably, opposing holes are disposed on the opposite sides of leg 81 and the button assembly includes two buttons (as shown in FIG. 20). In this case, the two opposing buttons 49 are engaged into two opposing first holes.

In the aspect shown in FIG. 18, the connectional leg 81 need only be configured with one hole defined by hole edges 73B, even when stem height adjustment ability is desired. This is because, when the leg 81 is repositioned as a conversion tee, adjustment is provided by the set of holes 73A disposed on base upright portion 90.

In the aspect shown in FIG. 19, if stem height adjustment is desired, the connectional leg 81 is configured with multiple holes defined by hole edges 96. This is because, when repositioned as a conversion tee, leg 81 may be adjusted higher or lower by use of one of the multiple holes defined by hole edges 96 that can be manually connected to button 49 of the base upright casing 90.

In a further aspect provided by the fifth embodiment of FIGS. 18-19, the tether mount 46E comprises a first hook 146 that is fixedly attached within the upwardly-projecting arm 45 and an opposing second hook 146 that is fixedly attached within the downwardly-projecting arm 55. The hook 146 is preferably configured with a small opening to reduce the chance that the cord-to-shaft connector 25 will be inadvertently knocked off the hook 146. Optionally, as shown in FIG. 19, the lower portion of the ball suspension may be disconnected to provide variety in swing training.

FIG. 20 illustrates a coupling assembly 159 as seen in FIG. 19 with a spring 78 that is to be disposed within the interior of an A portion of a frame or leg structure with only a depressible button 49 projecting outwardly through a hole 58 in the A portion. The B portion is then slid over the A portion with button 49 depressed. The button 49 is aligned with, and pops up into, the selected one of the set of holes 96.

To use the baseball/softball hitting training device 20, the player assembles the device 20, which, depending on the design of the device 20, may include all or some of the following steps. When using the device of the second and third embodiments, the weighted base 60B is filled with fill material. In the fourth and fifth embodiments, the legs 81, 82 of the base are connected to form the complete base 60D, 60E.

The vertical stem support section 41 of vertical stem 22 is attached to the base upright portion 90 of the base. The ball suspension system 30 is installed by attaching the upper and lower cord-to-shaft connectors 25 of the ball suspension system 30 to the shafts 42, 52. The player can then adjust the height via the stem height-adjustment system, if provided, which is disposed at the intersection of the stem support section 41 and the base upright portion 90, to position the ball 35 at the desired height for the hitting training drill to be performed. In the aspects of the invention that include an arm height-adjustment system 44 (shown in FIG. 14), the arm height-adjustment system 44, which is disposed at the intersection of the stem support section 41 and the upwardly-projecting arm 45, can be utilized by the player to increase or decrease the vertical swing opening (into which the ball is held on the ball suspension system), thereby increasing or decreasing the difficulty of the swing practice drill. The player then uses a bat to practice his/her swing to hit the suspended ball 35.

In the first, second, and third embodiments, if the player desires to use the device as a batting tee, the stem portion 41, the attached offset portion 50, and the attached ball suspension system 30 are removed from the base upright portion 90, and the tee insert 80 is inserted into the top of the base upright portion 90.

In the fourth embodiment, as seen in FIGS. 15-16, if the player desires to use the device as a batting tee, the stem portion 41, the attached offset portion 50, and the attached ball suspension system 30 are removed from the base upright portion 90. Then one connectional leg 81, 82 is removed from the T-shaped perpendicular portion 95, and the removed connectional leg 81, 82 is inserted into the top of the base upright portion 90.

In the fifth embodiment, as seen in FIGS. 18-19, if the player desires to use the device as a batting tee, the stem portion 41, the attached offset portion 50, and the attached ball suspension system 30 are removed from the base upright portion 90. Then one connectional leg 81 is removed from the tunnel connector 95B, and the removed connectional leg 81 is inserted into the top of the base upright portion 90.

When using the tee-type device, the stem height-adjustment system 44 can also be utilized by the player to adapt the height of the ball placed onto the batting tee insert 80 to the desired height for the hitting drill.

The material used to form the elastic cord of the tether 31 preferably has the qualities of resilience, extensibility, and tensile strength. Preferably a natural or synthetic rubber or a rubber composite is used. The diameter of the tether 31 is preferably between one-quarter inch and three-quarters inch. The rubber component may form a center core with a single-layer or multi-layer jacket over the inner elastic component. The jacket is typically formed of nylon and/or braided cotton. A shock cord-type material may be used. Optionally, resistance bands may be used.

Preferably in this fourth embodiment, the material forming the frame and base may be tubular metal; and most preferably, the material forming the frame and base may be cylindrical tubular metal.

The width or diameter of the base 60 may be in the range of 1 to 4 feet. The weighted base filled with the fill material may weigh in the range of 25 to 70 pounds, with around 35 pounds preferred. The multi-projection base may weigh from 7 to 50 pounds. The vertical stem 22 and base upright portion 90 preferably support the offset portion 50 from 15 to 40 inches from the ground. Preferably the vertical stem 22 and the base upright portion 90 may together adjust from 25 to 40 inches in height, with a 32-inch height being a typical usage height.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A ball hitting training device (20) comprising:

a base (60) comprising:

(a.) three leg projections comprising:

a. a foundational leg projections (62) comprising a distal portion and a base intermediary portion (68); said base intermediary portion (68) is disposed in an x axis orientation; said intermediary portion (68) comprises a first end (67), an opposing second end, and a tunnel connector (95B) fixedly and perpendicularly attached in an y axis orientation to said opposing second end;

b. a first connectional leg (82) comprising a proximal end (182) that is insertable into and through said tunnel connector (95B); wherein, when said proximal end (182) of said first connectional leg (82) is inserted into and through said tunnel connector (95B), a portion of said proximal end (182) extends outwardly beyond said tunnel connector (95B); and c. a second connectional leg (81) connectable to said portion of said proxiaml end (182) that extends outwardly said tunnel connector (95B);

(b.) a base upright portion (90) fixedly attached to and extending upwardly along a z axis from said intermediary portion (68);

a frame body (40) supported by said base (60); said frame body (40) comprising:

(a.) a vertical stem (22); and (b.) an offset portion (50) attached to said vertical stem (22); and (c.) a ball suspension system (30) supported by said frame body (40); and wherein said opposing connectional leg (81) is removable from said proximal end (182) and attachable to said base upright portion (90) to create a baseball practice tee.

2. The ball hitting training device (20) as recited in claim 1, wherein said opposing onnectional leg (81) further comprises a leg end cap (93) having a concave outer surface (89) that functions to receive a ball when said opposing connectional leg (81) is attached to said base upright portion (90) to create said baseball practice tee.

3. The ball hitting training device (20) as recited in claim 1, wherein said tunnel connector (95B) comprises exterior connector walls defining an interior tubular channel 195 that is sized and shaped to allow said connectional leg (82) to be inserted through said tunnel connector (95B).

4. The ball hitting training device (20) as recited in claim 1, further comprising a spring clip (78) with at least one button (49) disposed within said connectional leg (82); and wherein said connectional leg (82) comprises hole edges defining a hole that accommodates said at least one button (49).

5. The ball hitting training device (20) as recited in claim 1, further comprising a pin (56) that is used to join said connectional leg (82) to said opposing connectional leg (81).

6. The ball hitting training device (20) as recited in claim 1, further comprising a first height-adjustment device (159) disposed between said base (60) and said frame body (40).

7. The ball hitting training device (20) as recited in claim 1, further comprising a second height-adjustment device (159) disposed within said offset midsection (57).

8. The ball hitting training device (20) as recited in claim 7, wherein:

said offset portion (50) comprises:

a) an offset lower portion (59) connected to said vertical stem (22);

b) an offset midsection (57) that is offset from and not vertically aligned with said vertical stem (22); and c) an offset upper section (51) comprising a downwardly-projecting arm (55) aligned with said vertical stem (22).

9. The ball hitting training device (20) as recited in claim 8, further comprising a pin (56), wherein:

said offset midsection (57), comprises a lower portion (57A) and an upper portion (57B); and said second height-adjustment device (159) utilizes a pin (56) to join said lower portion (57A) to said upper portion (57B).

10. The ball hitting training device (20) as recited in claim 8, further comprising a spring clip (78) with at least one button (49), wherein:

said offset midsection (57), comprises a lower portion (57A) and an upper portion (57B); and said second height-adjustment device (159) utilizes said spring clip (78) to join said lower portion (57A) to said upper portion (57B).

11. A method of assembling a ball hitting training device (20) comprising:

connecting a foundational leg projection (62) to a first end of an intermediary portion (68) of a foundational leg projection (62) of a base (60);

inserting a proximal end (182) of a first connectional leg (82) into a tunnel connectior (95B) until a proximal end (182) of said connectional leg (82) extends beyond said tunnel connector (95B);

connection a second connectional leg (81) to said proximal end (182) of said connectional leg (82);

connection a frame body (40) to said base (60);

attaching a ball suspension system (30) that includes a ball (35) on a tether (31) to an offset portion (50) of said frame body (40);

disconnection said second connectional leg (81) from said proximal end (182) of said connectional leg (82);

disconnection said frame body (40) from said base (60); and connection said second connectional leg (81) to a base upright portion (90) of said intermediary portion (68) of a base (60) to form a baseball practice tee.

12. The method of assembling a ball hitting training device (20) as recited in claim 11, wherein said offset portion (50) of said frame body (40) comprises an offset lower midsection (57A) and an offset upper midsection (57B);

The method further comprising:

connection said offset lower midsection (57A) to said offset upper midsection (57B).

13. The method of assembling a ball hitting training device (20) as recited in claim 11, further comprising:

using a spring clip (78) with at least one button (49) to connect said second connectional leg (81) to said proximal end (182) of said connectional leg (82).

14. The method of assembling a ball hitting training device (20) as recited in claim 11, further comprising:

aligning holes (73A) in said connectional leg (82) with holes (73B) in said second connectional leg (81); and inserting a pin (56) through said aligned holes (76) to connect said second connectional leg (81) to said proximal end (182) of said connectional leg (82).

15. The method of assembling a ball hitting training device (20) as recited in claim 11, further comprising:

using a spring clip (78) with at least one button (49) to connect said frame body (40) to said base (60).

16. The method of assembling a ball hitting training device (20) as recited in claim 11, further comprising:

using a pin (56) to connect said frame body (40) to said base (60).

17. The methd of assembling a ball hitting training device (20) as recited in claim 11, further comprising:

using a spring clip (78) with at least one button (49) to connect said frame body (40) to said base (60).

* * * * *